US012697004B2

(12) United States Patent
Choi et al.

(10) Patent No.: US 12,697,004 B2
(45) Date of Patent: Aug. 4, 2026

(54) CLEANER

(71) Applicant: SAMSUNG ELECTRONICS CO., LTD., Suwon-si (KR)

(72) Inventors: Jiwon Choi, Suwon-si (KR); Kihwan Kwon, Suwon-si (KR); Kyoungwoung Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 312 days.

(21) Appl. No.: 18/401,991

(22) Filed: Jan. 2, 2024

(65) Prior Publication Data

US 2024/0298854 A1 Sep. 12, 2024

Related U.S. Application Data

(63) Continuation of application No. PCT/KR2023/019805, filed on Dec. 4, 2023.

(30) Foreign Application Priority Data

Mar. 8, 2023 (KR) ..... 10-2023-0030433

(51) Int. Cl.
*A47L 9/04* (2006.01)
*A47L 5/22* (2006.01)
(Continued)

(52) U.S. Cl.
CPC ..... *A47L 9/0477* (2013.01); *A47L 5/225* (2013.01); *A47L 5/30* (2013.01); *A47L 7/0066* (2013.01); *A47L 9/0411* (2013.01)

(58) Field of Classification Search
CPC ..... A47L 5/00; A47L 7/00; A47L 9/16; A47L 9/04
See application file for complete search history.

(56) References Cited

U.S. PATENT DOCUMENTS 9,999,330 B2 6/2018 Fang
10,588,472 B2 3/2020 Choi et al.
(Continued)

FOREIGN PATENT DOCUMENTS

CN 110522345 A 12/2019
CN 107456157 B 9/2020
(Continued)

OTHER PUBLICATIONS

International Search Report dated Apr. 9, 2024 for International Application No. PCT/KR2023/019805.
(Continued)

*Primary Examiner* — Michael D Jennings
(74) *Attorney, Agent, or Firm* — STAAS & HALSEY LLP

(57) ABSTRACT

Provided is a cleaner including: a housing having a suction port configured to take in foreign substances; a motor configured to generate a rotational force; and a drum brush inside the housing and configured to rotate by the rotational force, the drum brush including: a drum body having: a collecting portion having an opening, a tapered portion having a diameter that decreases along an axial direction of the drum body toward the collecting portion so that, when the drum brush rotates, the taken in foreign substances move toward the collecting portion and then through the opening, and a hollow, a core shaft in the hollow, and a cutting member in the hollow and on the core shaft at a position corresponding to the opening so that the foreign substances moved through the opening are cut by the cutting member.

15 Claims, 21 Drawing Sheets

(51) Int. Cl.
*A47L 5/30* (2006.01)
*A47L 7/00* (2006.01)

(56) References Cited

U.S. PATENT DOCUMENTS

| | | | | |
|---|---|---|---|---|
| 10,912,435 | B2 | 2/2021 | Kelsey | |
| 11,185,199 | B2 * | 11/2021 | Choi | A47L 9/0477 |
| 11,247,245 | B2 | 2/2022 | Brown et al. | |
| 11,284,760 | B2 * | 3/2022 | Hwang | A47L 9/04 |
| 11,707,171 | B2 | 7/2023 | Kelsey | |
| 2017/0280957 | A1 | 10/2017 | Jeong et al. | |
| 2020/0121144 | A1 | 4/2020 | Gacin et al. | |
| 2021/0212535 | A1 * | 7/2021 | Kegg | A46B 7/10 |
| 2022/0022711 | A1 * | 1/2022 | Lee | A47L 9/242 |
| 2022/0142427 | A1 | 5/2022 | Udy et al. | |

FOREIGN PATENT DOCUMENTS

| | | | | | |
|---|---|---|---|---|---|
| CN | 112674642 | A | | 4/2021 | |
| CN | 214342097 | U | | 10/2021 | |
| CN | 114532925 | A | | 5/2022 | |
| EP | 3944800 | A1 | * | 2/2022 | A47L 9/00 |
| JP | 10-33424 | A | | 2/1998 | |
| JP | 11-187994 | A | | 7/1999 | |
| JP | 6877589 | B2 | | 5/2021 | |
| JP | 2021-118886 | | | 8/2021 | |
| KR | 10-2014-0011673 | A | | 1/2014 | |
| KR | 10-2018-0079998 | A | | 7/2018 | |
| KR | 10-2020-0017723 | A | | 2/2020 | |
| KR | 10-2378092 | B1 | | 3/2022 | |
| WO | WO 2021/024738 | A1 | | 2/2021 | |
| WO | WO 2021/203457 | A1 | | 10/2021 | |

OTHER PUBLICATIONS

Written Opinion of the International Searching Authority dated Apr. 9, 2024 for International Application No. PCT/KR2023/019805.
Extended European Search Report dated Feb. 4, 2026 for European Application No. 23926535.8.

* cited by examiner (a)

(b)

CLEANER

CROSS-REFERENCE TO RELATED APPLICATIONS

This is a continuation application of International Application No. PCT/KR2023/019805, filed Dec. 4, 2023, which is incorporated herein by reference in its entirety, it being further noted that foreign priority benefit is based upon Korean Patent Application No. 10-2023-0030433, filed Mar. 8, 2023, which is incorporated by reference herein in its entirety.

TECHNICAL FIELD

The present disclosure relates to a cleaner including a drum brush.

BACKGROUND ART

In general, a cleaner is an appliance that cleans an area to be cleaned by sweeping or scattering foreign substances, such as dust or hair present in a cleaning space and intaking the foreign substances, such as the scattered dust or hair, by a suction force.

The cleaner includes a cleaner body, a suction head connected to the cleaner body by a connection pipe and having a suction port, and a drum rotatably mounted on the suction head.

The drum includes a drum body formed of hard metal or plastic, and a brush having a predetermined length on an outer circumferential surface of the drum body.

When foreign substances, such as dust or hair, in the cleaning space are scattered by the rotation of the drum, the foreign substances, such as scattered dust or hair, are drawn into the suction port by a suction force generated inside the cleaner body, and the drawn foreign substances are moved to a dust collecting container.

As the drum rotates, foreign substances, such as hair, animal hair, and thread, among the foreign substances drawn through the suction port may be caught between a plurality of brushes and wound around the drum, and the wound foreign substances may affect the performance and lifespan of the cleaner.

DISCLOSURE

Technical Problem

One aspect of the disclosure provides a cleaner that is easy to maintain.

One aspect of the disclosure provides a cleaner that is capable of easily removing foreign substances entangled in a drum brush.

One aspect of the disclosure provides a cleaner in which foreign substances are automatically cut as a drum brush rotates.

One aspect of the present disclosure provides a cleaner capable of drawing foreign substances tangled in a drum brush into a dust collector.

The technical objectives of the present disclosure are not limited to the above, and other objectives that are not described above may become apparent to those of ordinary skill in the art based on the following descriptions.

Technical Solution

According to an embodiment a cleaner may include: a housing having a suction port configured to take in foreign substances; a motor configured to generate a rotational force; and a drum brush inside the housing and configured to rotate by the rotational force. The drum brush may include a drum body having: a collecting portion having an opening, a tapered portion having a diameter that decreases along an axial direction of the drum body toward the collecting portion so that, when the drum brush rotates, the taken in foreign substances move toward to the collecting portion and then through the opening, and a hollow. The drum brush may include a core shaft in the hollow. The drum brush may include a cutting member in the hollow and on the core shaft at a position corresponding to the opening so that foreign substances moved through the opening are cut by the cutting member.

The core shaft may be fixed to the housing so that the core shaft may be prevented from rotating when the drum brush rotates.

The motor may be coupled to a first side of the drum brush, and the core shaft may be fixed to the housing on a second side of the drum brush opposite the first side.

The drum body may further include a plurality of protection guides covering at least a portion of the opening.

The plurality of protection guides may be formed along a circumferential direction of the drum body so that the taken in foreign substances may be wound around the drum brush and may move through the opening between the plurality of protection guides when the drum brush rotates.

The collecting portion may be positioned at a center of the drum body along the axial direction of the drum body.

The tapered portion may include a first tapered portion positioned on a first side of the collecting portion, and a second tapered portion positioned on a second side of the collecting portion.

The collecting portion may include a section extending along the axial direction of the drum body having a constant diameter.

The collecting portion may be at one end of the drum body.

The drum brush may further include a bearing configured to support the core shaft so that the drum body may rotate relative to the core shaft when the drum brush rotates.

The cutting member may pass through a center of the core shaft.

The cutting member may include a body portion coupled to the core shaft and a cutting portion protruding from the body portion.

The core shaft may be fixed to the housing and may include a recessed portion, and the cutting member may include a protruding portion corresponding to, and extending into, the recessed portion so that the cutting member may be restricted from rotating when the drum brush rotates.

The core shaft may further include a locking plate configured to restrict movement of the cutting member along a longitudinal direction of the core shaft.

The collecting portion may include a rubber material.

According to an embodiment a cleaner may include: a housing having a suction port configured to take in foreign substances; a motor configured to generate a rotational force; and a drum brush disposed inside the housing and configured to rotate by the rotational force. The drum brush may include a drum body including: a collecting portion having an opening, a tapered portion having a diameter that decreases along an axial direction toward the collecting portion so that, when the drum brush rotates, the taken in foreign substances move toward the collecting portion and through the opening, and a hollow. The drum brush may include a core shaft in the hollow and fixed to the housing so that the core shaft is restricted from rotating when the drum brush rotates. The drum brush may include a cutting member in the hollow, coupled to the core shaft at a position corresponding to the opening so that the foreign substances moved through the opening are cut by the cutting member.

According to an aspect, there is provided a cleaner according to an embodiment includes: a housing having a suction port configured to take in foreign substances; a motor configured to generate a rotational force; a drum brush disposed inside the housing and configured to rotate by the rotational force. The drum brush may include a drum body having: a collecting portion having an opening disposed at a center region of an axial direction of the drum body, a first tapered portion and a second tapered portion positioned on opposite sides of the collecting portion and having a diameter that decreases in a direction toward the collecting portion so that, when the drum brush rotates, the taken in foreign substances move toward the collecting portion and then through the opening. The drum brush may include a core shaft in the hollow of the drum body and fixed to the housing so that the core shaft is restricted from rotating when the drum brush rotates. The drum brush may include a cutting member in the hollow and on the core shaft so that foreign substances moved through the opening are cut by the cutting member.

Advantageous Effects

As is apparent from the above, according to an aspect of the disclosure, the cleaner can provide ease of maintaining.

According to an aspect of the disclosure, the cleaner can easily remove foreign substances entangled in a drum.

According to an aspect of the disclosure, the cleaner can allow foreign substances to be moved to the center of a drum according to rotation of the drum.

The effects of the present disclosure are not limited to those described above, and other effects that are not described above will be clearly understood by those skilled in the art from the above detailed description.

MODES OF THE DISCLOSURE

Figure 1:
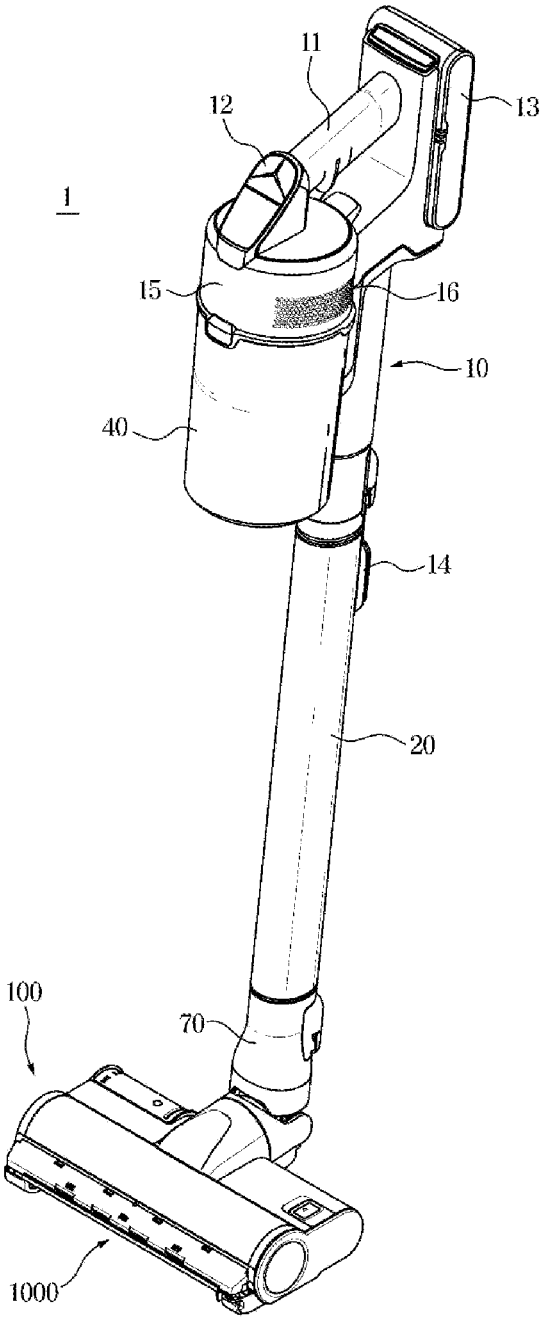
FIG. 1 is a perspective view illustrating a cleaner according to an embodiment of the present disclosure.

The embodiments described in the present specification and the configurations shown in the drawings are only examples of preferred embodiments of the disclosure, and various modifications may be made at the time of filing of the disclosure to replace the embodiments and drawings of the present specification.

Embodiments described in the specification and configurations shown in the accompanying drawings are merely exemplary examples of the disclosure, and various modifications may replace the embodiments and the drawings of the disclosure at the time of filing of the present application.

Further, identical symbols or numbers in the drawings of the disclosure denote components or elements configured to perform substantially identical functions.

Further, terms used herein are only for the purpose of describing particular embodiments and are not intended to limit to the disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc., may be used herein to describe various elements, the elements are not limited by the terms, and the terms are only used to distinguish one element from another. For example, a first element could be termed a second element, and similarly, a second element could be termed a first element without departing from the scope of the disclosure. The term "and/or" includes combinations of one or all of a plurality of associated listed items.

Further, the terms "upper-lower direction," "lower side," "front-rear direction," and the like used herein are defined with respect to the drawings, but the terms may not restrict the shape and position of the respective components.

In addition, although a stick cleaner, which is a type of a cleaner, will be described as an example for convenience of description, the configuration of the disclosure is not limited to the stick cleaner, and may be applied to other cleaners. For example, the configuration of the disclosure may be applied to a canister-type cleaner, a robot cleaner, and the like, which are types of cleaners other than stick cleaners.

Hereinafter, embodiments according to the disclosure will be described in detail with reference to the accompanying drawings.

Figure 2:
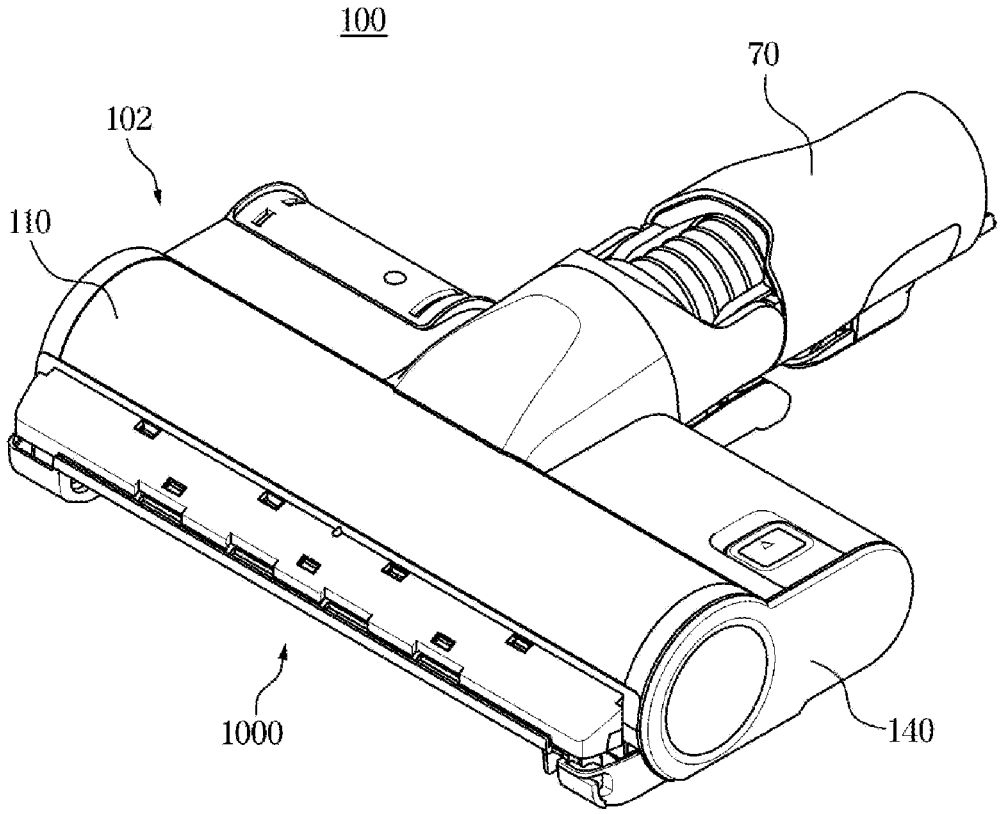
FIG. 2 is a perspective view illustrating a suction head of the cleaner shown in FIG. 1.
Figure 3:
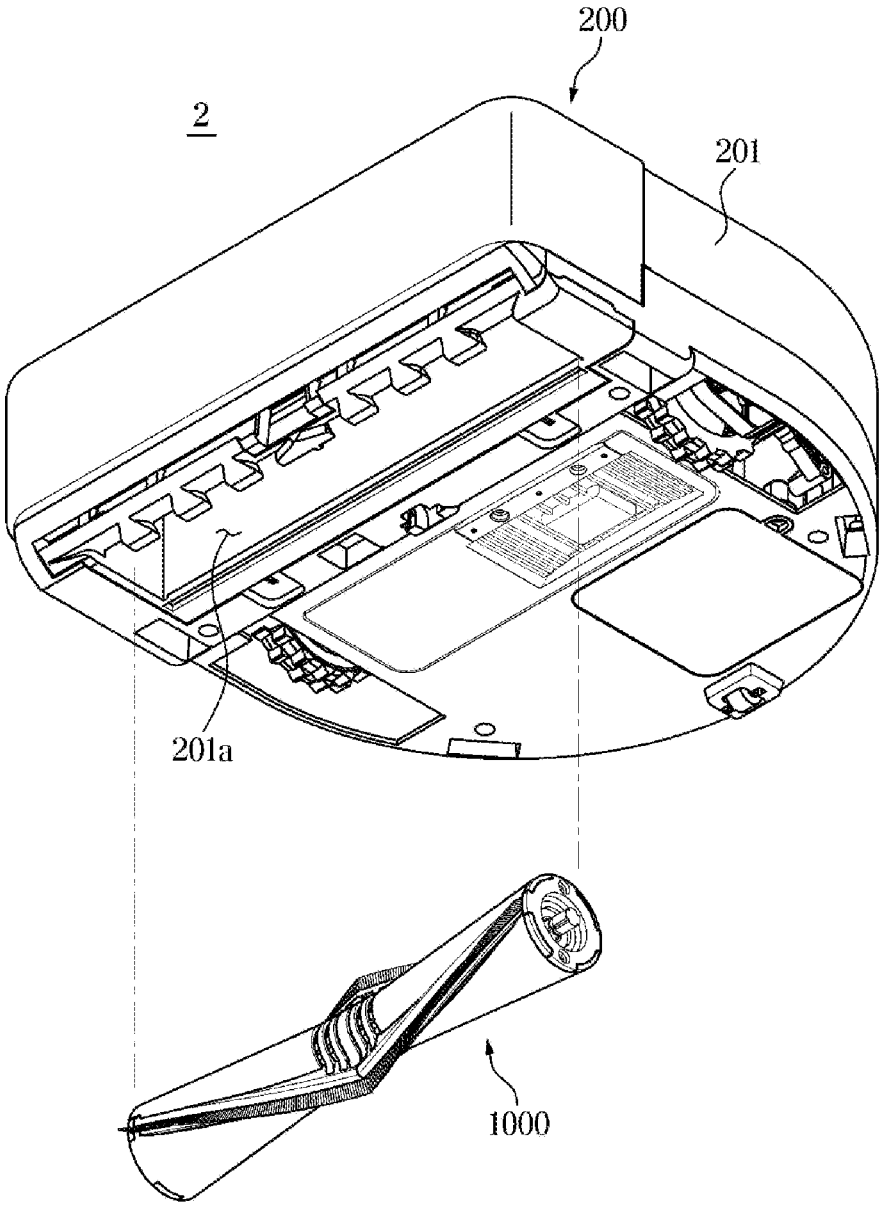
FIG. 3 is a diagram illustrating a drum brush mounted on a cleaner according to an embodiment.
Figure 4:
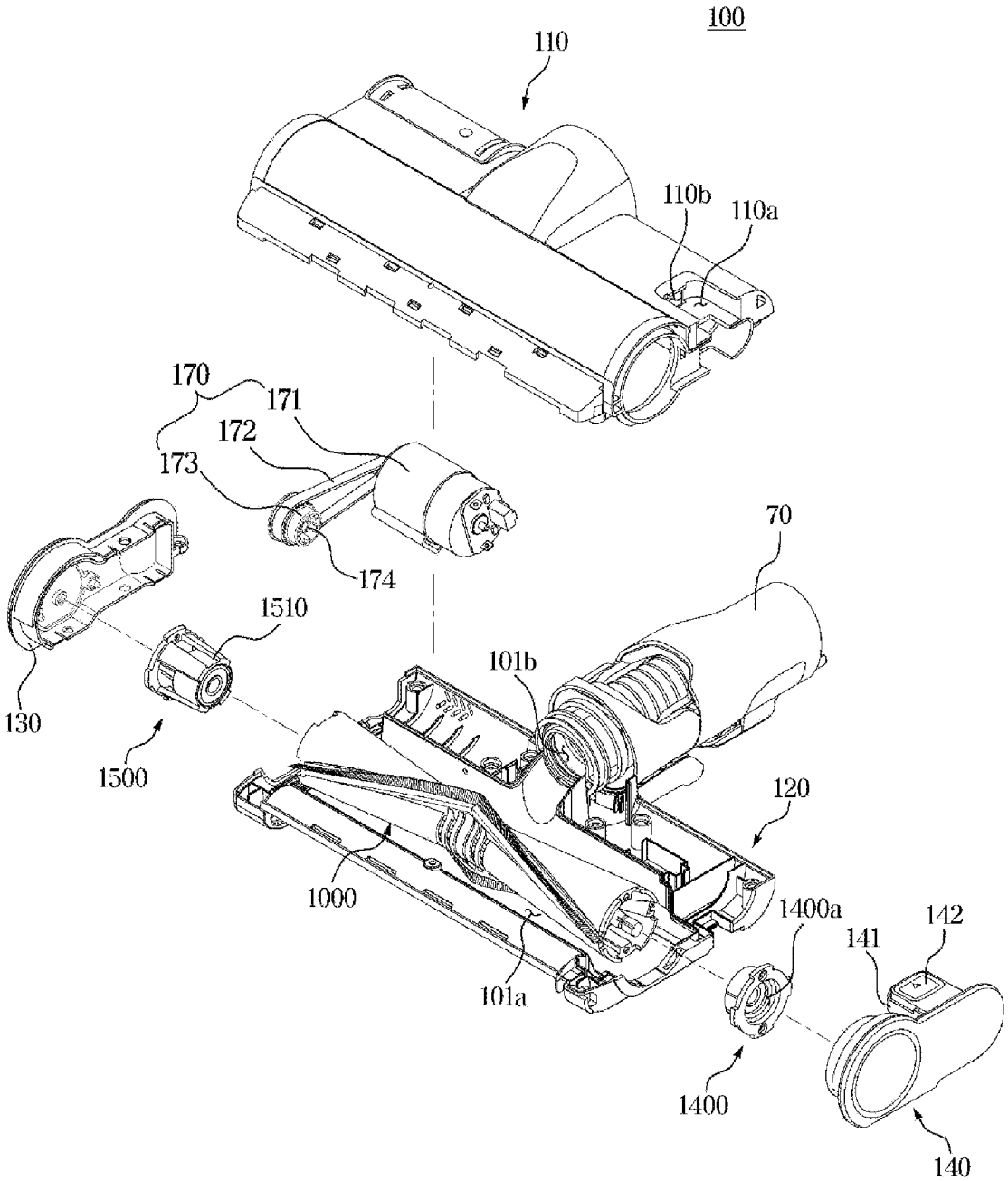
FIG. 4 is an exploded view illustrating the suction head of FIG. 2.
Figure 5:
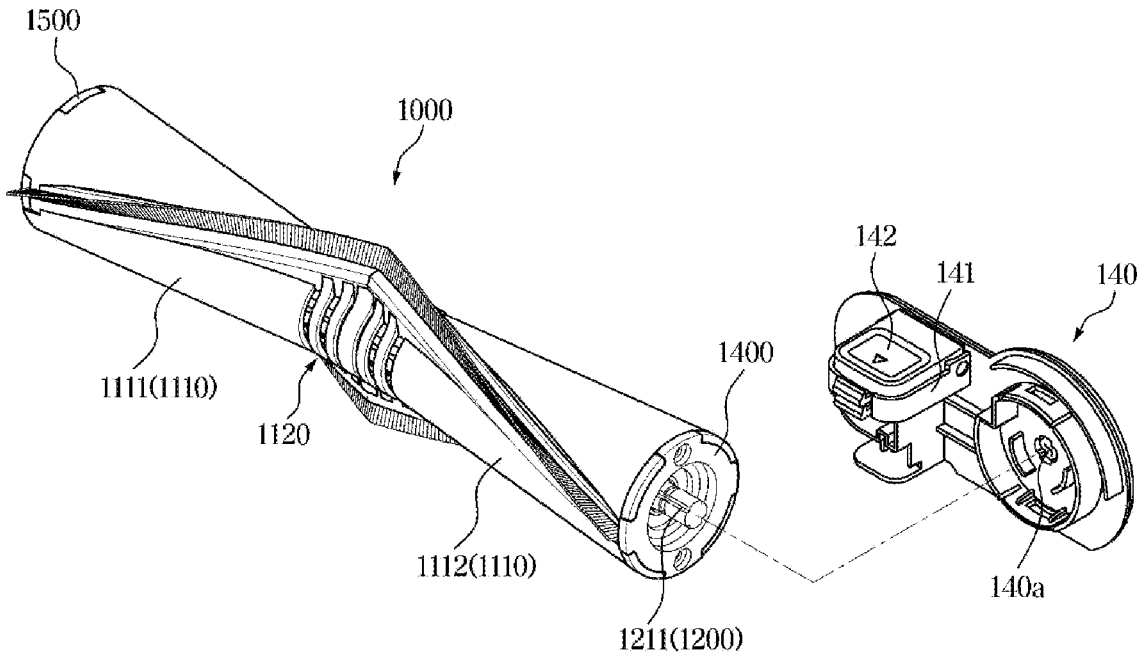
FIG. 5 is a diagram illustrating a method of coupling a drum brush and a housing.
Figure 6:
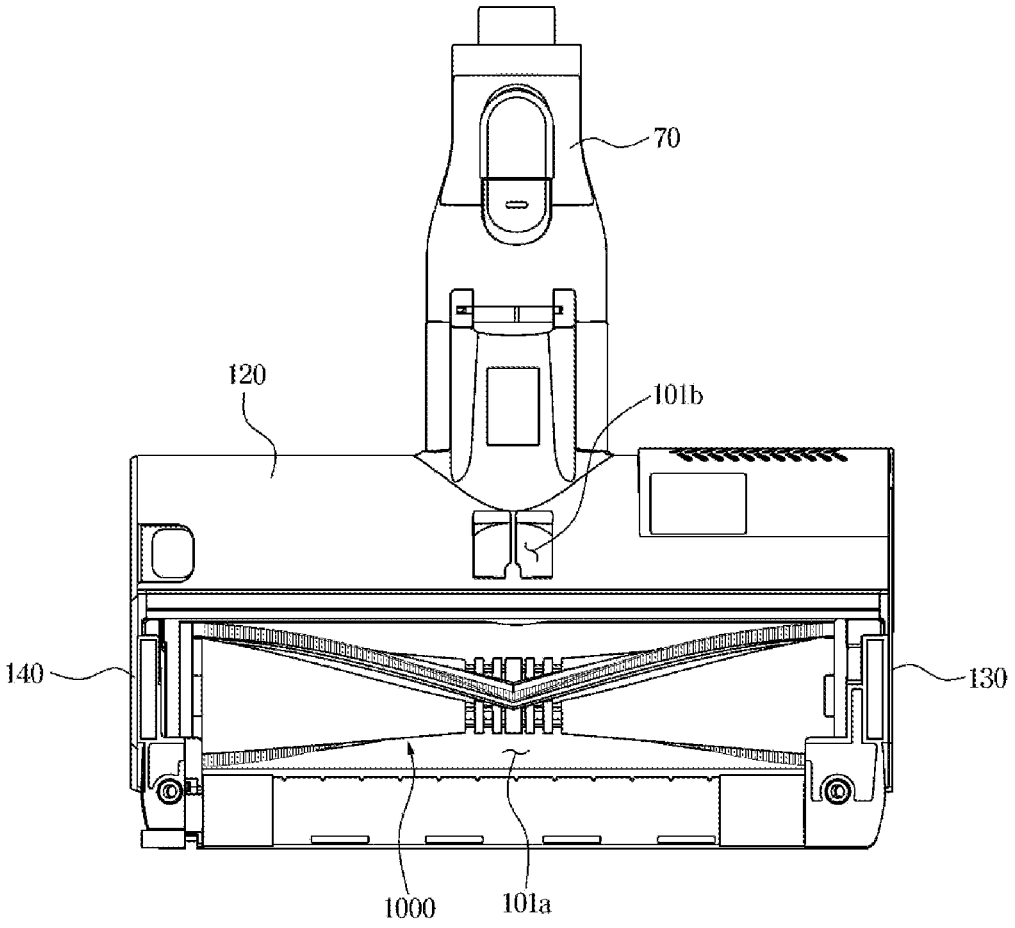
FIG. 6 is a bottom view illustrating a suction head on which a drum brush is mounted.

FIG. 1 is a perspective view illustrating a cleaner according to an embodiment of the present disclosure. FIG. 2 is a perspective view illustrating a suction head of the cleaner shown in FIG. 1. FIG. 3 is a diagram illustrating a drum brush mounted on a cleaner according to an embodiment. FIG. 4 is an exploded view illustrating the suction head of FIG. 2. FIG. 5 is a diagram illustrating a method of coupling a drum brush and a housing. FIG. 6 is a bottom view illustrating a suction head on which a drum brush is mounted.

Referring to FIGS. 1 to 6, a cleaner 1 includes a cleaner body 10, a suction head 100 connected to the cleaner body 10 by a connection pipe 20, and a drum brush 1000 rotatably coupled to the suction head 100.

The cleaner body 10 may include a dust collector 40 detachably coupled to the cleaner body 10 and a suction motor (not shown) provided to generate a suction force. The suction motor may be disposed inside a motor housing.

The dust collector 40 may be disposed more upstream of an air flow than the suction motor to separate dust or foreign substances included in the air flowing into an inlet 43 and store the separated dust or foreign substances. The dust collector 40 may include a dust separator (not shown) configured to separate dust or foreign substances included in the air introduced through a suction port (101*a* in FIG. 5) of the suction head 100, and a dust collecting container (not shown) provided to store the dust or foreign substances separated by the dust separator.

The dust collector 40 may be detachably coupled to the cleaner body 10. The dust collector 40 may include a button, and the button may be formed to allow the dust collector 40 to be separated from or coupled to the cleaner body 10.

The cleaner body 10 may include a handle 11 that is gripped by a user to manipulate the cleaner. A user may hold the handle 11 and move the cleaner in a forward and backward direction.

The cleaner body 10 may include a control portion 12. The user may turn on/off the cleaner or adjust the suction strength by manipulating a power button and the like provided on the control portion 12.

The cleaner body 10 may include a battery 13. The battery 13 may be detachably coupled to the cleaner body 10. When the battery 13 is discharged, the battery 13 may be replaced with a pre-charged battery 13 such that the operation time of the cleaner may be increased. Alternatively, the battery 13 may be integrally provided with the cleaner body 10.

The cleaner body 10 may include a filter housing 15. The filter housing 15 may be provided in a substantially donut shape and may accommodate a filter (not shown) therein. The type of the filter is not limited, but as an example, a high-efficiency particulate air (HEPA) filter may be disposed in the filter housing 15. The filter (not shown) may filter out ultrafine dust and the like that is not filtered by the dust separator of the dust collector 40. The filter housing 15 may include a plurality of holes 16 through which air passing through the filter is discharged to the outside of the cleaner.

The cleaner body 10 may include a connection pipe coupler 14. The connection pipe coupler 14 may be provided to allow the connection pipe 20 to be separated from or coupled to the cleaner body 10.

The connection pipe 20 may include a pipe having a predetermined rigidity or a flexible hose. The connection pipe 20 may transfer the suction force generated by the suction motor of the cleaner body 10 to the suction head 100 and guide air and foreign substances drawn through the suction head 100 to the cleaner body 10.

The suction head 100 may be connected to the cleaner body 10 by the connection pipe 20. The suction head 100 may be rotatably coupled to the connection pipe 20.

The suction head 100 may have the drum brush 1000 rotatably coupled thereto. The drum brush 1000 may be provided to be in contact with a surface to be cleaned and intake foreign substances, such as dust present on the surface to be cleaned into the suction head 100. Specifically, as the drum brush 1000 rotates, foreign substances on the surface to be cleaned may be drawn into the suction head 100 through the suction port 101*a* of the suction head 100. The foreign substances drawn into the suction head 100 may be forced by the suction motor of the cleaner body 10 to pass through a communication hole 101*b* that communicates the connection pipe 20 with the suction head 100 and then into the connection pipe 20, moving to a side of the cleaner body 10.

The suction head 100 may include a housing 102 having the suction port 101*a* and a suction connector 70 connecting the housing 102 and the connection pipe 20 to each other. Inside the suction head 100, disposed may be a drum brush 1000 rotatably provided on the suction head 1000 such that foreign substances may be effectively drawn into the housing 102 through the suction port 101*a*.

The housing 102 of the suction head 100 may be formed by assembling an upper housing 110, a lower housing 120, a side housing 130, and a drum detachable cover 140.

The side housing 130 may be provided while being coupled to the left side of the lower housing 120. In this case, the drum detachable cover 140 may be coupled to the right side of the drum brush 1000 and disposed on the right side of the lower housing 120. However, it is not limited thereto, and the left and right arrangement of the side housing 130 and the drum detachable cover 140 may be interchangeable.

The drum detachable cover 140 may be provided such that the drum body 1100 is rotatably coupled. As described above, the drum detachable cover 140 may be disposed on the right side of the lower housing 120, but it is not limited thereto.

The drum detachable cover 140 may include a fixing portion 141 and a cover switch 142 provided to allow the drum brush 1000 to be coupled to the housing 102. As the drum detachable cover 140 includes the fixing portion 141 and the cover switch 142, the drum brush 1000 may be detachably coupled to one side of the housing 102. Furthermore, the drum detachable cover 140 may also be detachably coupled to the upper housing 110 and the lower housing 120 together with the drum brush 1000 by the fixing portion 141 and the cover switch 142.

The fixing portion 141 may be formed to protrude from the drum detachable cover 140 toward the upper housing 110 and/or the lower housing 120. The fixing portion 141 may be provided with a fixing hook (reference numeral not denoted) and the cover switch 142 provided to press the fixing hook. The upper housing 110 may include an insertion groove 110*a* formed in a shape corresponding to the fixing portion 141 to allow the fixing portion 141 to be inserted thereinto. The insertion groove 110*a* of the upper housing 110 may be provided with a fastening groove 110*b* to which the fixing hook of the fixing portion 141 may be fixed.

According to the above configuration, the drum detachable cover 140 may be provided to be easily detached from the upper housing 110 and the lower housing 120, and the drum brush 1000 may also be provided to be easily separated from the housing 102 of the suction head 100. However, the above description of the configuration of the drum detachable cover 140 is only an example for detachably coupling the drum brush 1000 to the housing 102, and the configuration of the drum detachable cover 140 is not limited to the above description. For example, the drum detachable cover 140 may be detachably mounted on the upper housing 110 and the lower housing 120 in a different way. Alternatively, the drum brush 1000 may be separated from the housing 102 or installed to the housing 102 while the drum detachable cover 140 is coupled to the upper housing 110 and the lower housing 120.

The drum brush 1000 may include a driving cap 1500 and a shaft cap 1400 disposed at both ends of the drum brush 1000. Specifically, the driving cap 1500 may be disposed on one end, which is adjacent to the side housing 130, of the drum brush 1000, and the shaft cap 1400 may be disposed on the other end, which is adjacent to the drum detachable cover 140, of the drum brush 1000.

The driving cap 1500 may be disposed to cover one end of the drum brush 1000 and supported on one end of the drum brush 1000 and an inner circumferential surface of the drum body 1100. The driving cap 1500 may be provided to be fixed to one end of the drum body 1100 facing one side of the side housing 130. That is, the driving cap 1500 may be provided to be fixed to one end of the drum body 1100 facing the side housing 130.

The driving cap 1500 may be formed to have a cylindrical shape including a hollow so as to be inserted into the drum body 1100 and supported on the inner circumferential surface of the drum body 1100.

The shaft cap 1400 may be disposed to cover the other end opposite to the one end of the drum brush 1000 on which the driving cap 1500 is disposed, and may be supported on the other end of the drum brush 1000 and the inner circumferential surface of the drum body 1100.

The shaft cap 1400 may be formed to have a cylindrical shape including a hollow so as to be inserted into the drum body 1100 and supported on the inner circumferential surface of the drum body 1100. The shaft cap 1400 may have a shaft hole 1400*a* formed such that a part of the core shaft 1200 passes therethrough. The core shaft 1200 passing through the shaft hole 1400*a* may be inserted into a fixing groove 140*a* formed on the inner surface of the drum detachable cover 140.

For example, the core shaft 1200 may have a fixing end 1211 that is formed in a substantially cross shape. To correspond thereto, the fixing groove 140*a* may also be formed in a substantially cross shape. As the fixing end 1211 of the core shaft 1200 is inserted into the fixing groove 140*a* and fixed, the core shaft 1200 may remain stationary even while the drum body 1100 is rotating.

The core shaft 1200 may be provide to protrude from a part of the housing 102, e.g., from the drum detachable cover 140 in this illustration. That is, the core shaft 1200 may be integrally formed with the housing 102. In this case, the drum body 1100 may be mounted on the core shaft 1200 protruding from the housing 102.

In addition, the core shaft 1200 may be formed of a metal material, or one end of the core shaft 1200, that is, the fixing end 1211, may be formed of a metal material. A part of the housing 102, that is, the drum detachable cover 140 may include a magnet to fix the core shaft 1200. In other words, the core shaft 1200 may be fixed by magnetic force.

As described above, a method by which the core shaft 1200 is fixed to the housing 102 is not limited thereto and may be performed in various ways.

The suction head 100 may include the driving device 170. The driving device 170 may include a motor 171 positioned inside the housing 102 and generating rotational force. The driving device 170 may include a motor bearing 173 positioned on one side of the drum brush 1000 and coupled to a rotation shaft. The driving device 170 may include a pulley 172 having one side coupled to the motor bearing 173 and the other side coupled to a rotating shaft of the motor 171 to transmit power of the motor 171 to the drum brush 1000. However, the disclosure is not limited thereto, and the motor 171 may be directly coupled to the driving cap 1500 to transmit rotational force.

As a result, when the motor 171 generates power and the rotating shaft of the motor 171 rotates, the pulley 172 moves, and due to the movement of the pulley 172, the motor bearing 173 rotates.

The motor bearing 173 may be coupled to the driving cap 1500 of the drum body 1100. The motor bearing 173 may include a coupling portion 174 provided on the inside thereof to be coupled to the driving cap 1500. As the motor bearing 173 rotates, the driving cap 1500 coupled to the motor bearing 173 may rotate together with the motor bearing 173 by the coupling portion 174. Since the driving cap 1500 is coupled to the drum body 1100, the drum body 1100 may also rotate together with the driving cap 1500. A brush member 1700 disposed to protrude or coupled to the drum body 1100 may also rotate together with the drum body 1100, shaking off foreign substances from the surface to be cleaned.

As described above, the core shaft 1200 positioned inside the drum body 1100 may be fixed while the fixing end 1211 is inserted into the fixing groove 140*a* on the inside of the drum detachable cover 140. Accordingly, the core shaft 1200 may remain stationary even when the drum body 1100 rotates.

In the above description, the cleaner 1 equipped with the suction head 100, such as a stick cleaner, has been described, but the drum brush 1000 according to the disclosure may be mounted on a robot cleaner 2 without a suction head 100, such as a robot cleaner 2.

Referring to FIG. 3, the robot cleaner 2 may include a cleaner body 200 capable of moving on the surface to be cleaned, and a housing 201 forming the external appearance of the cleaner body 200.

The housing 201 may include a suction port 201*a* to intake foreign substances, such as dust, from the surface to be cleaned. The suction port 201*a* may be provided on the bottom surface of the cleaner body 200. The drum brush 1000 may be positioned at the suction port 201*a*. The drum brush 1000 may be rotatably mounted on the suction port 201*a*, as in the cleaner 1 described above.

Hereinafter, the configuration and function of the drum brush 1000 will be described in detail.

Figure 7:
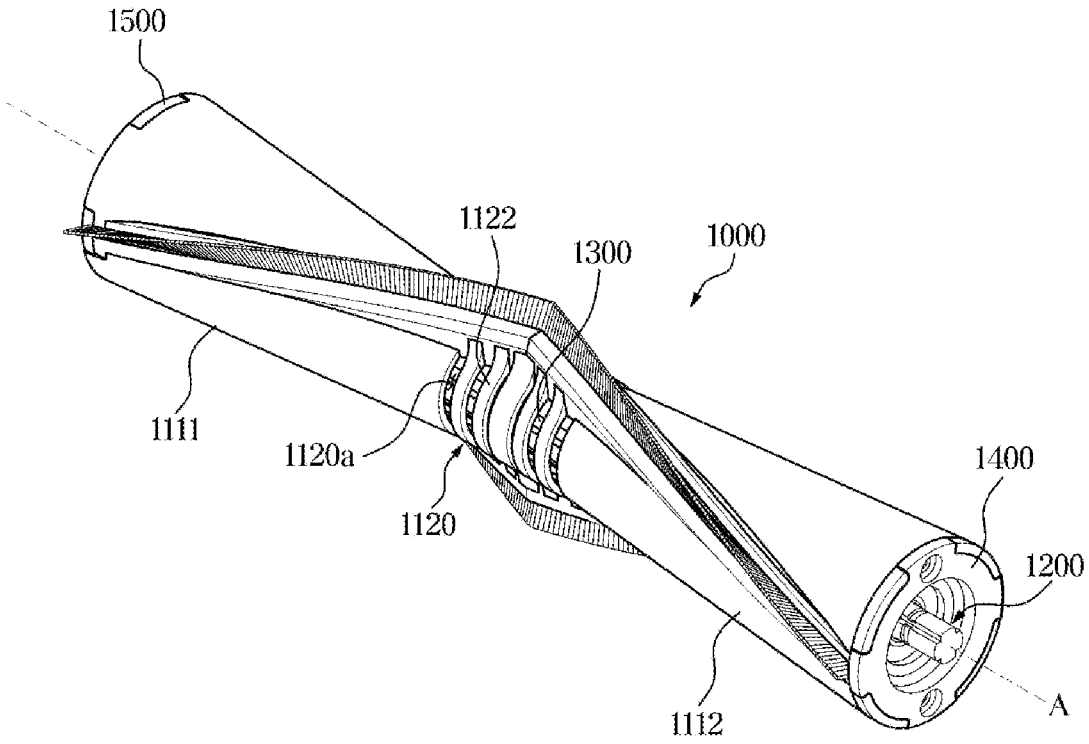
FIG. 7 is a diagram illustrating a drum brush according to an embodiment.
Figure 8:
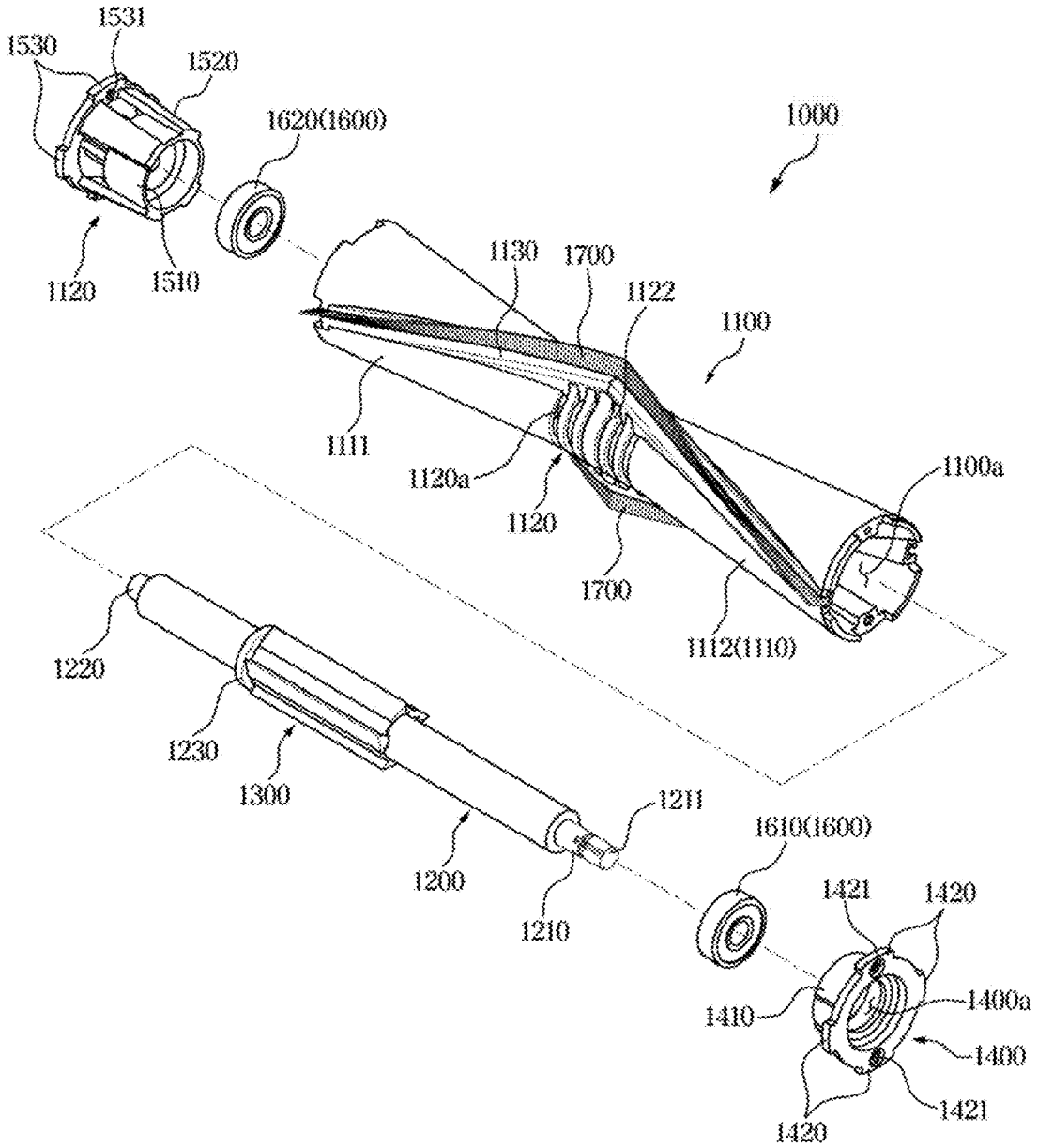
FIG. 8 is an exploded view illustrating some components of the drum brush of FIG. 7 which are disassembled.

FIG. 7 is a diagram illustrating a drum brush 1000 according to an embodiment. FIG. 8 is an exploded view illustrating some components of the drum brush 1000 of FIG. 7 which are disassembled.

Referring to FIGS. 7 and 8, the drum brush 1000 may include a drum body 1100 having a hollow 1100*a*. The hollow 1100*a* may be formed inside the drum body 1100 such that the core shaft 1200 serving as a rotation axis of the drum body 1100 may be placed therein.

The drum brush 1000 may include a brush member 1700 protruding from the drum body 1100. The brush member 1700 may be provided in at least one unit thereof. The brush member 1700 may be provided in a plurality thereof.

Although the brush members 1700 are illustrated as being arranged in opposite directions, the brush member 1700 may be formed as one brush member or three or more brush members. In addition, even when the brush members 1700 is formed as three or more brush members, the brush members 1700 may be arranged within a specific angle rather than being spaced apart from each other at an angle of 120 degrees.

The brush member 1700 may be formed by gathering a plurality of bristles having a predetermined rigidity to scatter foreign substances by hitting or sweeping the surface to be cleaned. The brush member 1700 may be substantially a broom or brush. The brush member 1700 may be formed of a nylon material or silicon material, but it is not limited thereto, and the brush member 1700 may include a plurality of bristles such as a soft fiber bristle, a cotton flannel, and the like.

The drum body 1100 may include a coupling portion 1130 to which the brush member 1700 is coupled. The coupling portion 1130 may protrude from the outer circumferential surface of the drum body 1100 and may extend along the longitudinal direction of the drum body 1100. In addition, the coupling portion 1130 may be provided corresponding in number to the number of brush members 1700.

As described above, the core shaft 1200 may be fixed to the housing 102 and serve as a rotation axis. That is, the drum body 1100 may rotate around the core shaft 1200 by the rotational force generated by the motor 171 of the driving device 170.

The core shaft 1200 may include a first insertion portion 1210 formed at one end and a second insertion portion 1220 formed at the other end. The first insertion portion 1210 may include a fixing end 1211 that may be inserted into the fixing groove 140*a* provided on the inside of the drum detachable cover 140. The first insertion portion 1210 may be inserted into a first bearing 1610 positioned on the inside of the shaft cap 1400. The first bearing 1610 may support the core shaft 1200 through the first insertion portion 1210.

The first insertion portion 1210 penetrating the first bearing 1610 may be exposed to the other side of the drum brush 1000 through the shaft hole 1400*a* formed in the shaft cap 1400. The fixing end 1211 exposed on the other side of the drum brush 1000 may be inserted into the fixing groove 140*a* and fixed to the housing 102.

The second insertion portion 1220 may be inserted into a second bearing 1620 positioned on the inside of the driving cap 1500. The second bearing 1620 may support the core shaft 1200 through the second insertion portion 1220.

As described above, the driving device 170 may rotate the drum body 1100 relative to the core shaft 1200. That is, the first bearing 1610 and the second bearing 1620 may allow the drum body 1100 to rotate relative to the core shaft 1200.

The drum body 1100 may be provided to be rotatable by the driving device (170 in FIG. 4). As the drum body 1100 rotates, the brush member 1700 may scatter foreign substances H on the surface to be cleaned and thus the foreign substances H may be drawn into the suction head 100.

The drum body 1100 may receive a rotational force from a driving source, such as the driving device 170 such that the drum body 1100 may rotate with respect to the suction head 100. The drum body 1100 may be provided to be rotatable with respect to the surface to be cleaned as the driving cap 1500 coupled to one side of the drum body 1100 rotates.

The drum brush 1000, as a rotating body that rotates about a direction along an axis A, may have a substantially cylindrical shape, but it is not limited thereto. The drum brush 1000 may be provided as a polygonal column close to a cylindrical shape. For example, the drum brush 1000 may have a hexagonal cross section which is cut in a direction perpendicular to the axis A. Alternatively, the cross section of the drum brush 1000 may be oval. When the drum brush 1000 is provided in a polygonal column shape, since the brush member 1700, the coupling portion 1130 or the like may be provided on a flat surface, manufacturing may be facilitated. In addition, since the shape may become similar to the cylindrical shape shown in the drawing as the number of facets of the cross section of the drum 1000 increases, the shape may be changed as needed.

The diameter of the drum body 1100 described in the specification may be taken to mean the diameter of the drum body 1100 when the drum body 1100 during rotation has a cylinder-like shape even when the drum body 1100 is provided in the form of a polygonal column. Therefore, even when the drum body 1100 does not have a substantially cylindrical shape but has a polygonal column shape, the expression, the diameter of the drum body 1100, does not lose its meaning.

At least a portion of the drum body 1100 may be formed in a cylindrical shape. Since the drum body 1100 is a rotating body, the drum body 1100 may be formed to be symmetrical about the axis A. The driving cap 1500 coupled to one side of the drum body 1100 and the shaft cap 1400 coupled to the other side of the drum body 1100 may both be positioned on the axis A.

The drum body 1100 may include tapered portions 1110 having a diameter that decreases from both ends in the direction of the axis A toward the center, and a collecting portion 1120 positioned between the tapered portions 1110. The tapered portion 1110 may be provided in a substantially truncated cone shape. The collecting portion 1120 may be formed in a cylindrical shape having the same diameter as the diameter of a part of the tapered portion 1110 adjacent to the center. That is, the collecting portion 1120 may be provided to have a constant diameter. However, it is not limited thereto, and the collecting portion 1120 may have a bent shape at a position in which the tapered portions 1110 on both sides meet each other.

As described above, even when the cross section of the drum body 1100 is formed as an ellipse or polygon rather than a circle, the tapered portion 1110 may be formed to have a cross section that decreases toward the collecting portion 1120.

The tapered portions 1110 may include a first tapered portion 1111 positioned on one side of the drum body 1100 and a second tapered portion 1112 positioned on the other side of the drum body 1100. The first tapered portion 1111 and the second tapered portion 1112 may be provided symmetrically with each other. The collecting portion 1120 may be positioned between the first tapered portion 1111 and the second tapered portion 1112. The first tapered portion 1111 and the collecting portion 1120 may be continuously formed without a step therebetween, and the second tapered portion 1112 and the collecting portion 1120 may also be continuously formed without a step therebetween. However, it is not limited thereto, and the collecting portion 1120 may be formed to be stepped with respect to the first tapered portion 1111 and the second tapered portion 1112.

The collecting portion 1120 has been described as one collecting portion between the tapered portions 1110 positioned on both sides thereof, but it is not limited thereto. For example, the collecting portion 1120 may be provided as two or more collecting portions 1120 close to the center of the drum body 1100. When the collecting portion 1120 is provided as two or more collecting portions 1120, the two or more collecting portions 1120 may be formed symmetrical with respect to the center. Even when the collecting portion 1120 is provided as two or more collecting portions 1120, the two or more collecting portions 1120 may be positioned close to the communication hole 101*b*.

Figure 17:
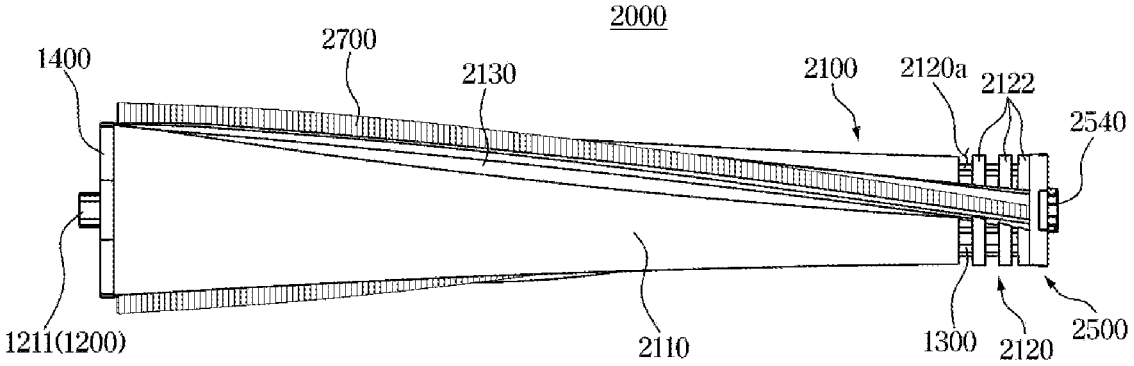
FIG. 17 is a diagram illustrating a drum brush according to an embodiment.

When the collecting portion 1120 is provided as two or more collecting portions 1120, the collecting portion 1120 may have a section in which the diameter increases again in a direction from the collecting portion 1120 toward the center of the drum body 1100. That is, the diameter may decrease from the tapered portion 1110 toward the collecting portion 1120, and then increase again from the collecting portion 1120 to the center of the drum body 1100. When the drum body 1100 is viewed from a side in a direction perpendicular to the axis A of the drum 1000, the drum body 1100 may have an approximately W-shape. However, as shown in FIG. 17, which will be described below, the drum body 2100 may be provided in a substantially truncated cone shape.

The tapered portion 1110, due to the diameter decreasing toward the center, that is, toward the collecting portion 1120, may be formed in a substantially hourglass shape. In the tapered portion 1110, long foreign substances, such as hair, wound on a high-speed rotating body such as the drum 1000 tend to be drawn into a part having a small diameter, such as the collecting portion 1120 as being nearing the collecting portion 1120. Accordingly, during use of the cleaner 1, the foreign substances H wound around the drum brush 1000 may gradually move to the collecting portion 1120.

The drum body 1100 may include an opening 1120*a* formed in the collecting portion 1120. Foreign substances H may be introduced into the hollow 1100*a* through the opening 1120*a*. Foreign substances H may come in contact with a cutting member 1300 only by entering the hollow 1100*a* at a certain level. Therefore, the foreign substances H need to be strongly wound around the collecting portion 1120.

The drum body 1100 may include a metal material or a plastic material. The collecting portion 1120 of the drum body 1100 may include a rubber material. The collecting portion 1120 may be obtained by a rubber material padded on the drum body 1100 formed of metal or plastic. Foreign substances H, such as moved hair, may be more strongly wound around the collecting portion 1120 including a rubber material.

The driving cap 1500 may include a driving cap body 1510 having a cylindrical shape so as to be inserted into the drum body 1100. The driving cap body 1510 may be provided on an inner circumferential surface thereof with a space into which the second bearing 1620 is inserted. The core shaft 1200 disposed inside the drum body 1100 may be inserted into the center of the second bearing 1620.

When the driving cap 1500 rotates by receiving the rotational force generated by the driving device 170, the rotational force may not be transmitted to the core shaft 1200 due to the second bearing 1620. Accordingly, only the drum body 1100 may be rotated by the rotational force generated by the driving device 170.

The driving cap body 1510 may be provided with a cap fixing protrusion 1520 on the outer circumferential surface thereof. The cap fixing protrusion 1520 may be provided in plural. Each of the plurality of cap fixing protrusions 1520 may be spaced apart from each other on the outer circumferential surface of the driving cap body 1510 at a predetermined interval.

The driving cap 1500 may include a driving cap head 1530 that covers one side of the drum body 1100. The driving cap head 1530 may be provided in a protruding manner having a substantially cross shape. To correspond to the driving cap head 1530, a groove may be formed on the one side of the drum body 1100 in a substantially cross shape. The driving cap head 1530 may be coupled to one end of the drum body 1100 to cover the hollow 1100*a* of the drum body 1100.

Similarly, the shaft cap 1400 may include a shaft cap body 1410 having a cylindrical shape so as to be inserted into the drum body 1100. Although not shown, similar to the driving cap body 1510, a cap fixing protrusion (not shown) may be formed on the outer circumferential surface of the shaft cap body 1410. The cap fixing protrusion (not shown) may be provided in plural. Each of the plurality of cap fixing protrusions (not shown) may be disposed on the outer circumferential surface of the shaft cap 1400 at a predetermined interval.

The shaft cap 1400 may include a shaft cap head 1420 that covers the other side of the drum body 1100. The shaft cap head 1420 may be provided in a protruding manner having a substantially cross shape. To correspond to the shaft cap head 1430, a groove may be formed on the other side of the drum body 1100 in a substantially cross shape. The shaft cap head 1430 may be coupled to the other end of the drum body 1100 to cover the hollow 1100*a* of the drum body 1100.

The shaft cap 1400 may have a shaft hole 1400*a* formed to pass through the shaft cap body 1410 and the shaft cap head 1420. A part of the core shaft 1200 may be exposed to the outside of the drum body 1100 through the shaft hole 1400*a*. More specifically, the fixing end 1211 of the core shaft 1200 may be exposed to the outside of the drum body 1100 and fixed to the housing 102.

The drum body 1100 may be provided on the inner circumferential surface thereof with cap fixing grooves (not shown) to correspond to the cap fixing protrusion 1520 of the driving cap 1500 and the shaft cap head 1420 of the shaft cap 1400. The cap fixing grooves (not shown) may be formed at both ends of the drum body 1100, respectively, in which the driving cap 1500 and the shaft cap 1400 are disposed. Each of the cap fixing protrusion 1520 and the shaft cap head 1420 may be inserted into a corresponding one of the cap fixing groove 1520 and the cap fixing protrusion (not shown), and the driving cap 1500 and the shaft cap 1400 may be individually fixed to the inner circumferential surface of the drum body 1100.

However, the above description of the drum brush 1000 including the driving cap 1500 and the shaft cap 1400 is only an example in which the drum brush 1000 is rotatably coupled to the suction head 100, and the configuration of the drum brush 1000 is not limited thereto. The driving cap 1500 and the shaft cap 1400 may be coupled to the drum body 1100 differently from the above description, or the drum brush 1000 may not include the driving cap 1500 or the shaft cap 1400.

The drum brush 1000 may include a cutting member 1300 provided in the core shaft 1200. The cutting member 1300 may be exposed through the opening 1120*a* formed in the collecting portion 1120 to cut the foreign substances H. The cutting member 1300 may be formed integrally with the core shaft 1200, or may be coupled to the core shaft 1200 as a separate component. In this illustration, the cutting member 1300 is described as being coupled to the core shaft 1200 as a separate component.

The cutting member 1300 may be formed at a position corresponding to the opening 1120*a* of the drum body 1100. In this illustration, since the collecting portion 1120 is provided in the center of the drum body 1100, the cutting member 1300 may also be positioned in the center of the core shaft 1200. However, since a drum body 2000 shown in FIG. 17 has a collecting portion 2120 positioned at the end of the drum body 2000, the cutting member 1300 may also be positioned at the end of the core shaft 1200.

The cutting member 1300 may include a metal material. The cutting member 1300 may include a sharp blade to cut foreign substances H such as hair. The cutting member 1300 may be formed by coating diamond on metal. In addition, the cutting member 1300 may be formed of approximately sandpaper material. The blade of the cutting member 1300 may extend along the direction of the axis A of the drum body 1100.

Since the core shaft 1200 is fixed, the cutting member 1300 may also be fixed. Accordingly, as the drum body 1100 rotates, the foreign substances H may be moved to the collecting portion 1120 and cut by the cutting member 1300 exposed through the opening 1120*a*. That is, only by operating the cleaner 1, the foreign substances H wound around the drum brush 1000 may be moved to the collecting portion 1120 and cut by the cutting member 1300.

Since the cutting member 1300 includes a sharp blade, there is a risk of injury to the user. Accordingly, the drum body 1100 may include a plurality of protection guides 1122 formed on the opening 1120*a*. The plurality of protection guides 1122 may be provided to cover at least a portion of the opening 1120*a*. However, since the foreign substances H need to be positioned inside the drum body 1100, that is, in the hollow 1100*a*, to the extent that the foreign substances H come in contact with the cutting member 1300 through the opening 1120*a*, the plurality of protection guides 1122 need to cover only a portion of the opening 1120*a*.

Since the foreign substances H are wound along the rotational direction R of the drum body 1100, the plurality of protection guides 1122 may be formed along the circumferential direction of the drum body 1100. That is, the plurality of protection guides 1122 may be formed along the rotation direction R of the drum body 1100. Due to the plurality of protection guides 1122 formed along the circumferential direction of the drum body 1100, a plurality of slits may be formed. Foreign substances H may be introduced through between the plurality of protection guides 1122, and the introduced foreign substances H may be in contact with the cutting member 1300 and be cut.

Since the cutting member 1300 needs to be disposed at a position corresponding to the opening 1120*a*, the core shaft 1200 may include a locking plate 1230 provided to restrict the cutting member 1300 from moving along the longitudinal direction of the core shaft 1200.

The locking plate 1230 may be provided at an appropriate position such that the cutting member 1300 may be placed at a position corresponding to the opening 1120*a*. Although the locking plate 1230 is illustrated as a substantially disk shape, the locking plate 1230 may be provided in various configurations as long as it can restrict the movement of the cutting member 1300. For example, the locking plate 1230 may be provided in various shapes, such as a substantially bar shape or a square shape.

Figure 12:
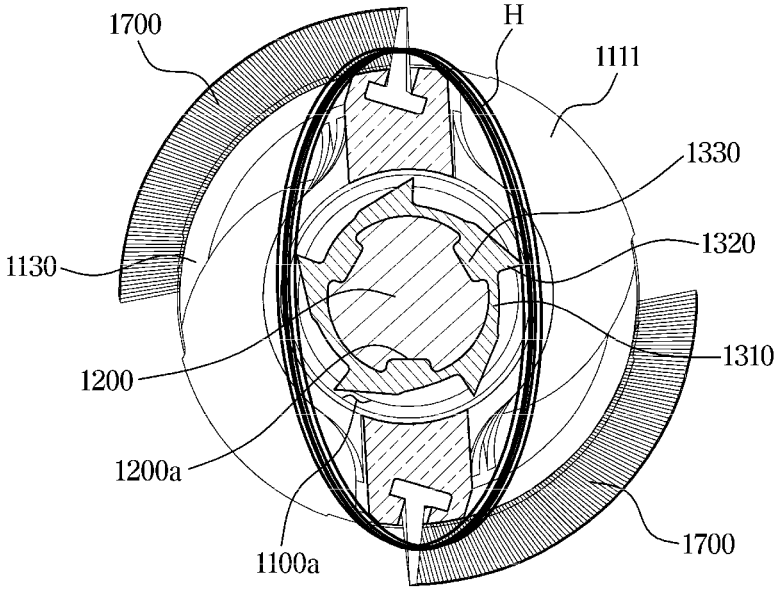
FIG. 12 is a diagram illustrating foreign substances being cut by a cutting member.
Figure 12:
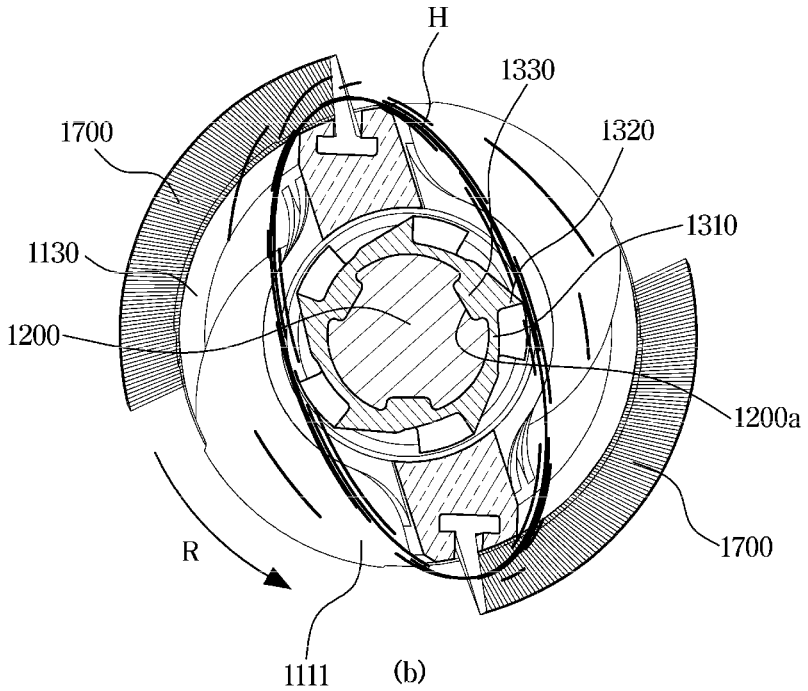

In addition, the cutting member 1300 may include a protruding portion 1330 (e.g., as shown in FIG. 12) such that the cutting member 1300 is prevented from rotating on the core shaft 1200. The configuration for preventing rotation of the cutting member 1300 will be described below.

Hereinafter, a process in which the foreign substances H wound around the drum brush 1000 are cut by the cutting member 1300 will be described in detail.

Figure 9:
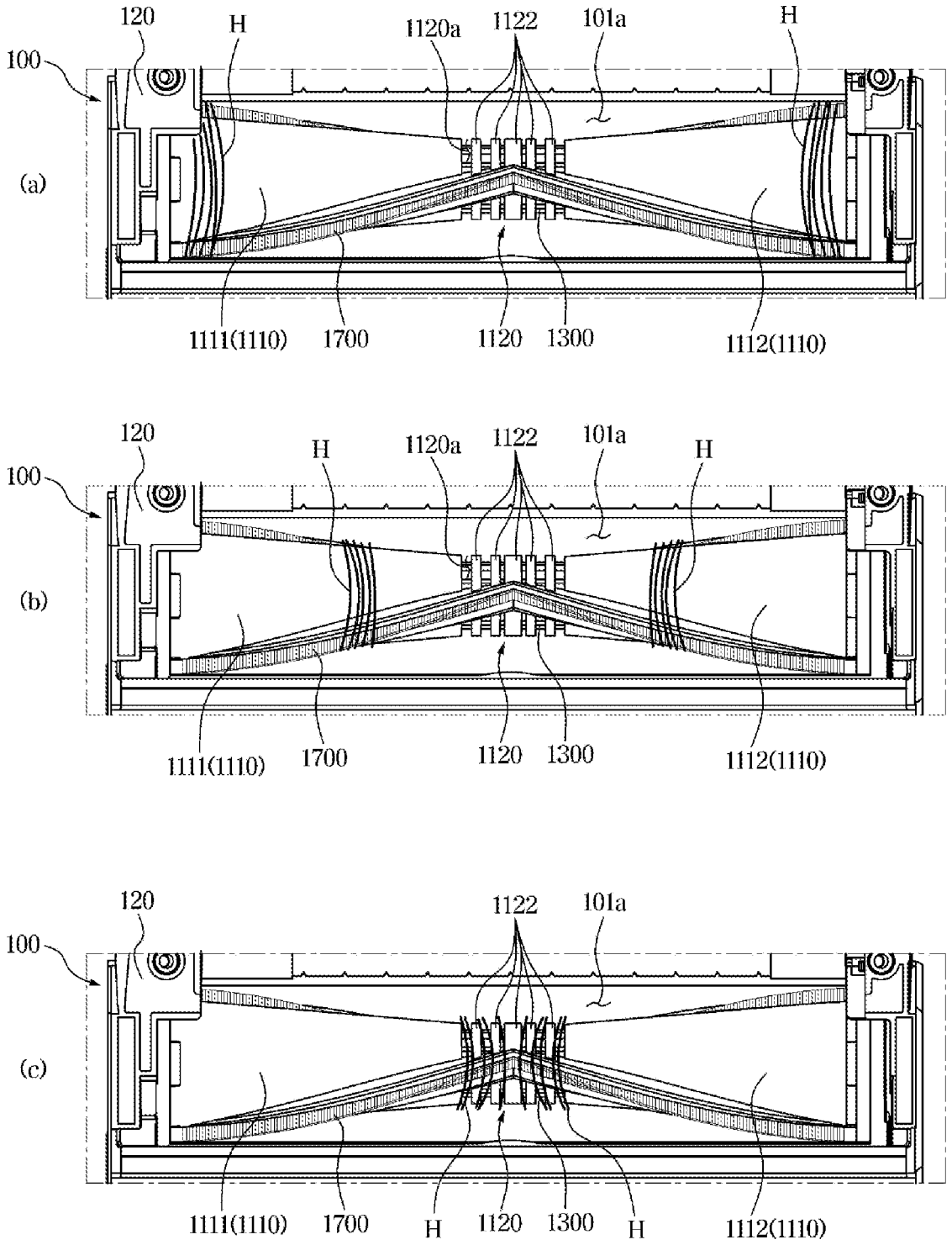
FIG. 9 is a diagram illustrating a sequence in which foreign substances H wound around the drum brush 1000 of FIG. 7 move to the collecting portion 1120 as the drum brush 1000 rotates.
Figure 10:
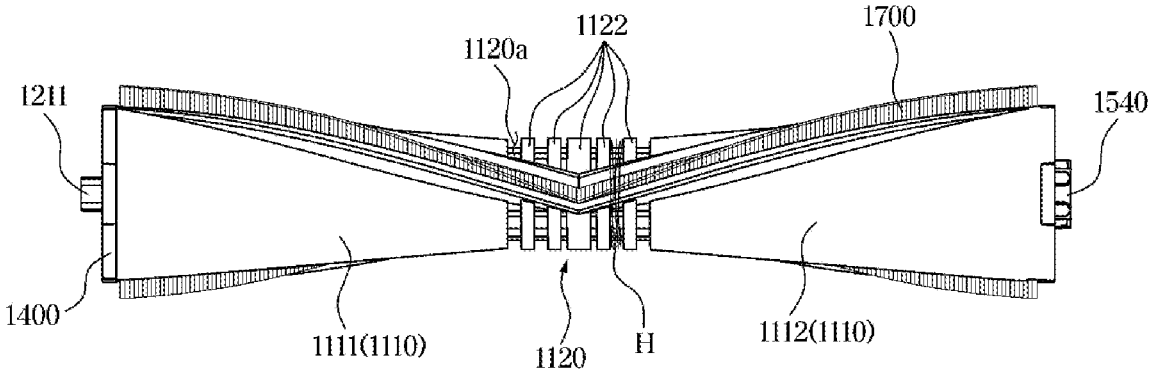
FIG. 10 is a diagram illustrating a state in which foreign substances are wound around the collecting portion of the drum brush of FIG. 7.
Figure 11:
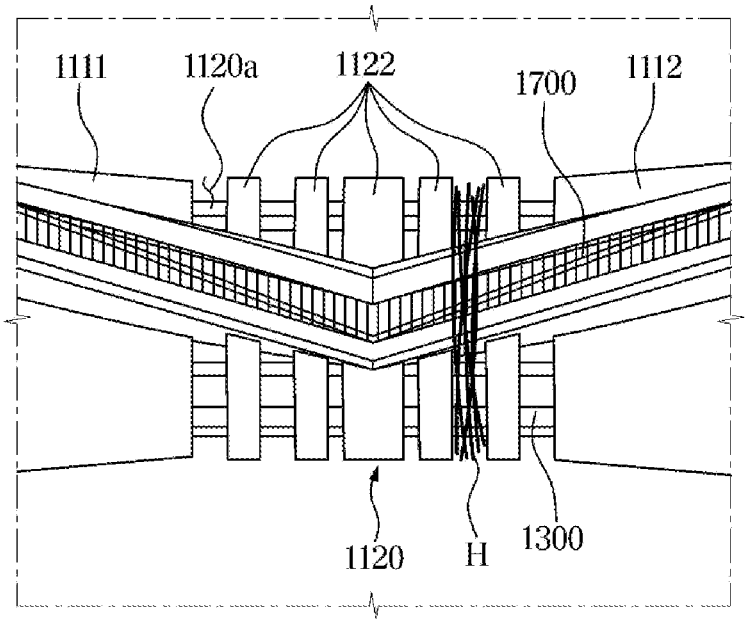
FIG. 11 is an enlarged view of the collecting portion of FIG. 10.

FIG. 9 is a diagram illustrating a process in which foreign substances wound around the drum brush of FIG. 7 moves to the collecting portion as the drum body rotates. FIG. 10 is a diagram illustrating a state in which foreign substances are wound around the collecting portion of the drum brush of FIG. 7. FIG. 11 is an enlarged view of the collection part of FIG. 10.

Referring to FIGS. 9 to 12, the drum brush 1000 mounted on the suction port 101*a* of the suction head 100 may be rotated by the operation of the cleaner 1. More specifically, the core shaft 1200 and the cutting member 1300 among components of the drum brush 1000 may be fixed, and the drum body 1100 may be rotated.

Since the brush member 1700 protruding from the drum body 1100 is composed of a plurality of bristles, long foreign substances H such as hair are easily caught in the brush member 1700. The foreign substances H may be difficult to escape unless removed separately by the user after cleaning is completed, and thus the foreign substances H left without being removed may lower the performance of the cleaner 1 and cause breakdown. Therefore, there is a need to remove foreign substances H caught on the brush member 1700.

Referring to FIG. 9, as the cleaner 1 according to the present disclosure operates, foreign substances H may be wound around the drum brush 1000. The drum body 1100 may be provided to have a diameter that decreases in a direction toward the collecting portion 1120. As described above, foreign substances H wound in a high-speed rotating body tend to move toward a place with a small diameter. Therefore, as the drum body 1100 rotates, the foreign substances H may be moved to the collecting portion 1120.

The foreign substances H moved to the collecting portion 1120 may be introduced into the opening 1120*a* formed in the collecting portion 1120. The foreign substances H introduced into the opening 1120*a* may be positioned close to the cutting member 1300 to the extent that the foreign substances H come in contact with the cutting member 1300.

The drum body 1100 may be rotated by the driving device 170, and the core shaft 1200 and the cutting member 1300 may be fixed. That is, the driving device 170 may rotate the drum body 1100 relative to the core shaft 1200 and the cutting member 1300. In this way, the foreign substances H may move relative to the core shaft 1200 and the cutting member 1300 and may cut as being into contact with the cutting member 1300.

The cut foreign substances H may no longer be wound around the drum brush 1000 and may fall onto the surface to be cleaned. Since the foreign substances H are in a cut state, the cut foreign substances H may not be long enough to be wound around the drum brush 1000 again and thus directly drawn into the dust collector 40 through the suction port 101*a* and the communication hole 101*b*.

Even when the cut foreign substances H are wound around the drum brush 1000 again, the foreign substances H may be cut again through the above process and eventually be drawn into the dust collector 40.

Figure 13:
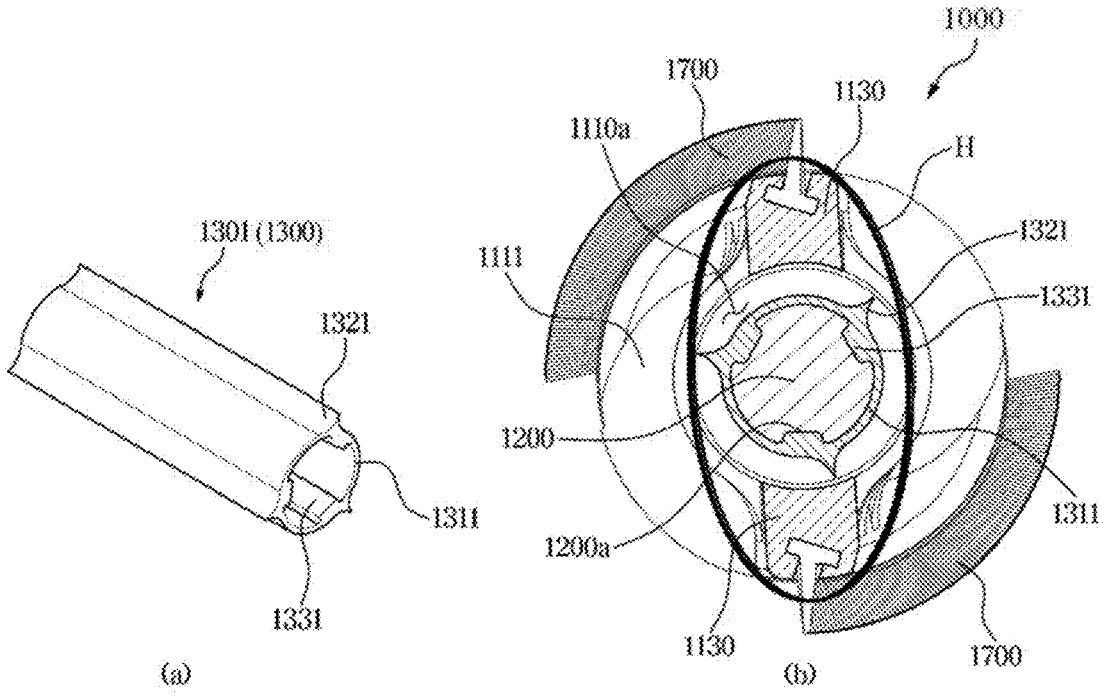
FIG. 13 is a cross-sectional views illustrating a cutting member and a drum brush on which the cutting member is mounted, according to an embodiment.
Figure 14:
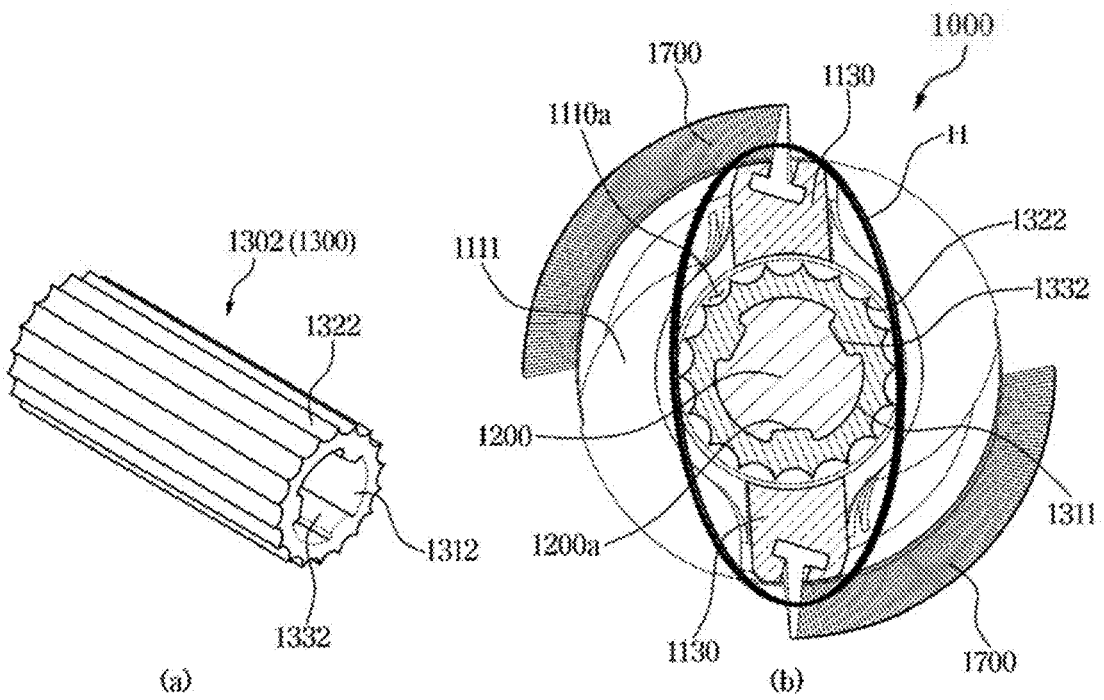
FIG. 14 is a cross-sectional views illustrating a cutting member and a drum brush on which the cutting member is mounted, according to an embodiment.
Figure 15:
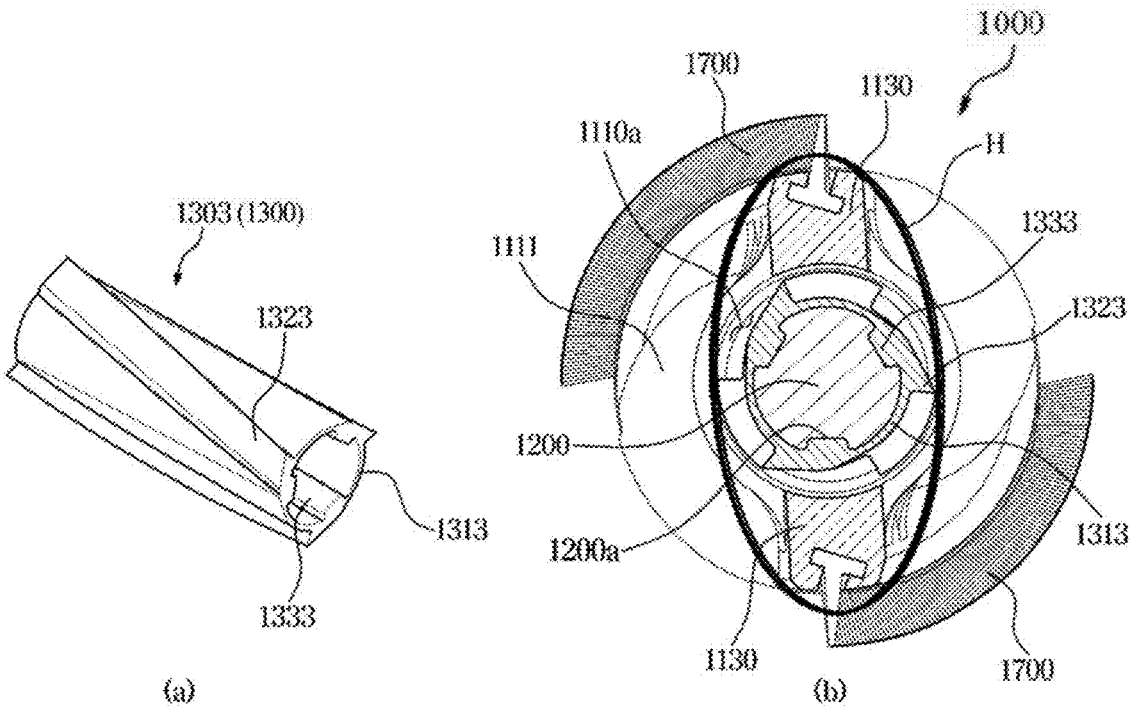
FIG. 15 is a cross-sectional views illustrating a cutting member and a drum brush on which the cutting member is mounted, according to an embodiment.
Figure 16:
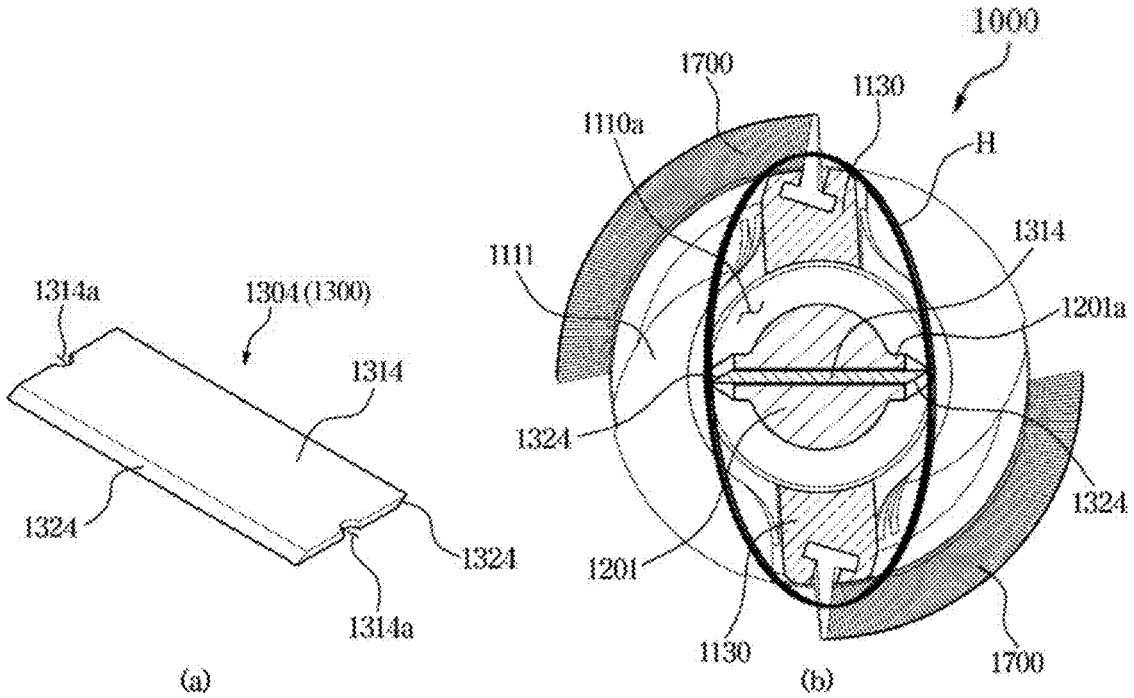
FIG. 16 is a cross-sectional views illustrating a cutting member and a drum brush on which the cutting member is mounted, according to an embodiment.

FIG. 13 is a cross-sectional view illustrating a cutting member 1301 and a drum brush 1000 on which the cutting member 1301 is mounted, according to an embodiment. FIG. 14 is a cross-sectional view illustrating a cutting member 1302 and a drum brush 1000 on which the cutting member 1302 is mounted, according to an embodiment. FIG. 15 is a cross-sectional view illustrating a cutting member 1303 and a drum brush 1000 on which the cutting member 1303 is mounted, according to an embodiment. FIG. 16 is a cross-sectional view illustrating a cutting member 1304 and a drum brush 1000 on which the cutting member 1304 is mounted, according to an embodiment. Referring to FIGS. 13 to 16, the cutting member 1300 may be provided in various forms, and common configurations of each cutting member 1300 will be described first, and then other configurations will be individually described.

First, cutting members 1301, 1302, and 1303 may include body portions 1311, 1312, and 1313 for coupling to the core shaft 1200. In addition, the cutting members 1301, 1302, and 1303 may include cutting portions 1321, 1322, and 1323 that protrude in the radial direction from the body portions 1311, 1312, and 1313.

In this illustration, the body portions 1311, 1312, and 1313 are illustrated as having a substantially cylindrical shape, but they are not limited thereto. When the core shaft 1200 is provided in a polygonal shape, such as a quadrangular pillar or a triangular pillar, the body portions 1311, 1312, and 1313 may also have a polygonal cross-section, such as a quadrangle or triangle.

The core shaft 1200 may include a recessed portion 1200*a* to prevent rotation of the cutting members 1301, 1302, and 1303, and the cutting members 1301, 1302, and 1303 may be provided on the inner circumferential surfaces thereof with protruding portions 1331, 1332, and 1333 corresponding to the recessed portion 1200*a*.

Although the core shaft 1200 is fixed to the housing (102 in FIG. 4), the cutting member 1300 may be rotated by an external force, such as a force generated by rotation of the drum body 1100. Accordingly, the protruding or recessed structure of the core shaft 1200 and the cutting member 1300 may prevent the cutting member 1300 from rotating.

In this illustration, the recessed portion 1200*a* is provided as three units thereof and the protruding portion 1331, 1332, 1333 is provided as three units thereof, but the disclosure is not limited thereto, and even when the recessed portion and the protruding portion are each provided as one unit thereof, rotation of the cutting members 1301, 1302, and 1303 may be prevented.

Conversely, a protruding portion may be provided on the core shaft 1200, and a recessed portion may be provided on the cutting members 1301, 1302, and 1303.

In addition, in this illustration, the core shaft 1200 is shown as having recessed portions by a repeated configuration of protrusions and recessions, and the inner circumferential surface of each of the cutting members 1301, 1302, and 1303 are shown as having protruding portions by a repeated configuration of protrusions and recessions. As such, it is sufficient as long as each of the core shaft 1200 and the cutting members 1301, 1302, and 1303 has a protrusion and recession structure, and the structures are provided to correspond to each other.

However, the core shaft 1200 and the cutting members 1301, 1302, and 1303 do not need to have such a protruding or recessed structure, and the inner circumferential surface of the cutting members 1301, 1302, and 1303 may be formed of a rubber material with high friction, or coated with a sticky material to prevent rotation of the cutting members 1301, 1302, and 1303.

The above configuration may be equally applied to the cutting member 1300 shown in FIGS. 7 to 12.

Meanwhile, the cutting members 1301, 1302, and 1303 shown in FIGS. 13 to 15 may include cutting portions 1321, 1322, and 1323 of different shapes. The cutting portions 1321, 1322, and 1323 may be provided in a radial shape, a serration shape, a helical shape, a grinder shape, and the like.

The cutting portions 1321, 1322, and 1323 of the cutting members 1301, 1302, and 1303 may be provided in various forms as long as they protrude enough to cut the wound foreign substances H. The cutting members 1301, 1302, and 1303 shown herein are merely examples, and may be provided in any shape as long as it can exhibit the technical features of the present disclosure.

Referring to FIG. 16, the cutting member 1304 may include a body portion 1314 having a rectangular shape and including a long side and a short side. In addition, the cutting member 1304 may include cutting portions 1324 provided on opposite sides of the body portion 1314.

The cutting member 1304 may be disposed by penetrating the core shaft 1200. The cutting member 1304 may be inserted along a direction in which the cutting portion 1324 is formed. The cutting member 1304 may penetrate to pass through the center of the core shaft 1200, that is, to pass through the axis A of the drum brush 1000. The cutting member 1304 may be inserted into the core shaft 1200 along the short side direction of the cutting member 1304. Accordingly, the body portion 1314 of the cutting member 1304 may be positioned inside the core shaft 1200, and the cutting portion 1324 may be positioned outside the core shaft 1200.

In this case, the core shaft 1200 may include a slot 1201*a* and a fixing hole (not shown) to limit the position of the cutting member 1304. That is, the cutting member 1304 may be fitted into the slot 1201*a*.

In addition, the cutting member 1304 may include a fixing groove 1314*a* provided on the short side of the body portion 1314. With the cutting member 1304 inserted into the core shaft 1200, a fixing screw (not shown) may be inserted into the fixing hole (not shown) of the core shaft 1200 to thereby connect the core shaft 1200 and the cutting member 1304. In this case, the fixing groove 1314*a* of the cutting member 1304 may be positioned to correspond to the fixing hole (not shown).

Similar to the cutting members 1300, 1301, 1302, and 1303 of FIGS. 7 to 15 described above, the cutting member 1304 may be exposed through the opening 1120*a* and configured to cut the wound foreign substances H.

Hereinafter, detailed descriptions of the same configurations as those described for the drum brush 1000 shown in FIGS. 7 to 12 may be omitted, and other configurations will be described in detail.

Figure 18:
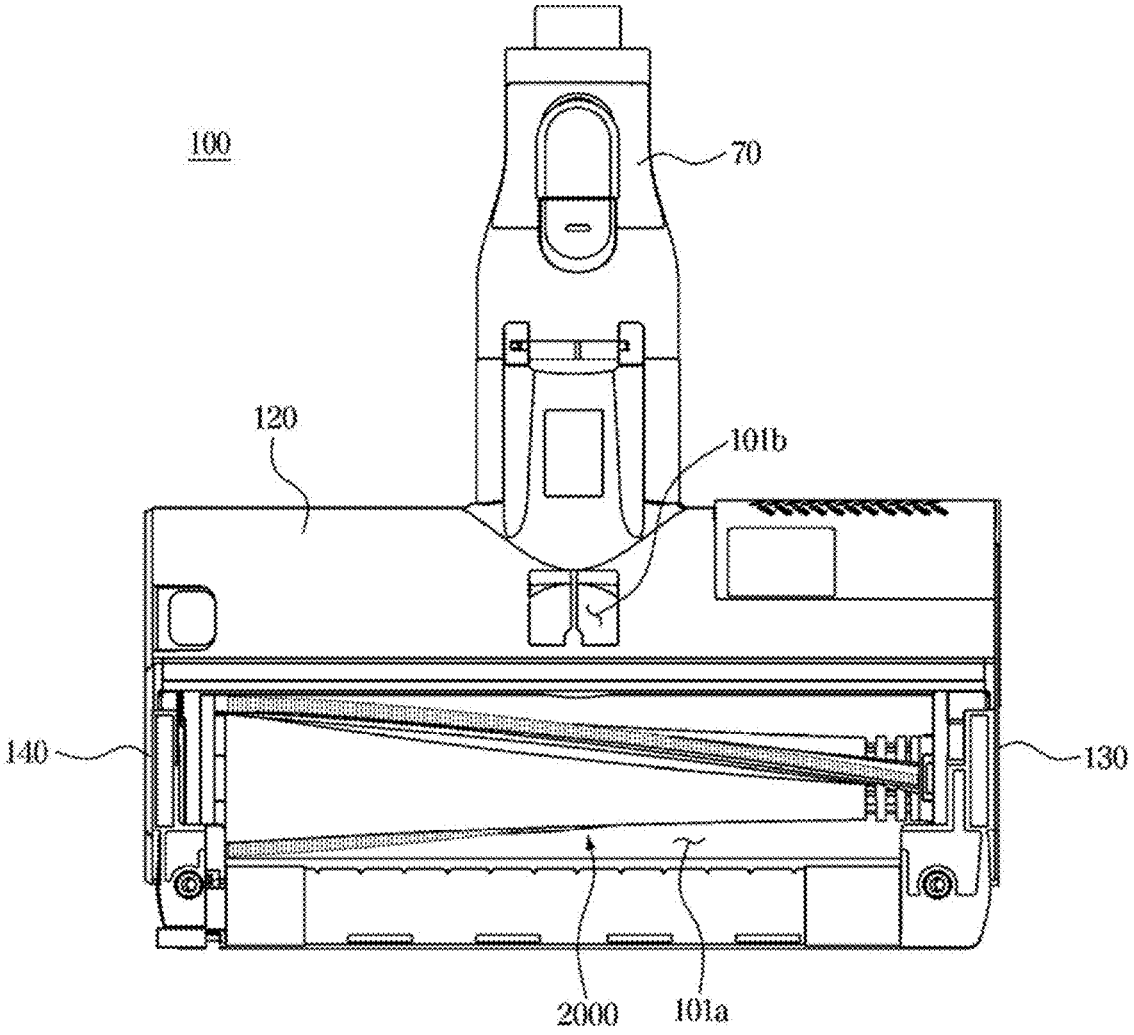
FIG. 18 is a bottom view illustrating a suction head on which the drum brush of FIG. 17 is mounted.
Figure 19:
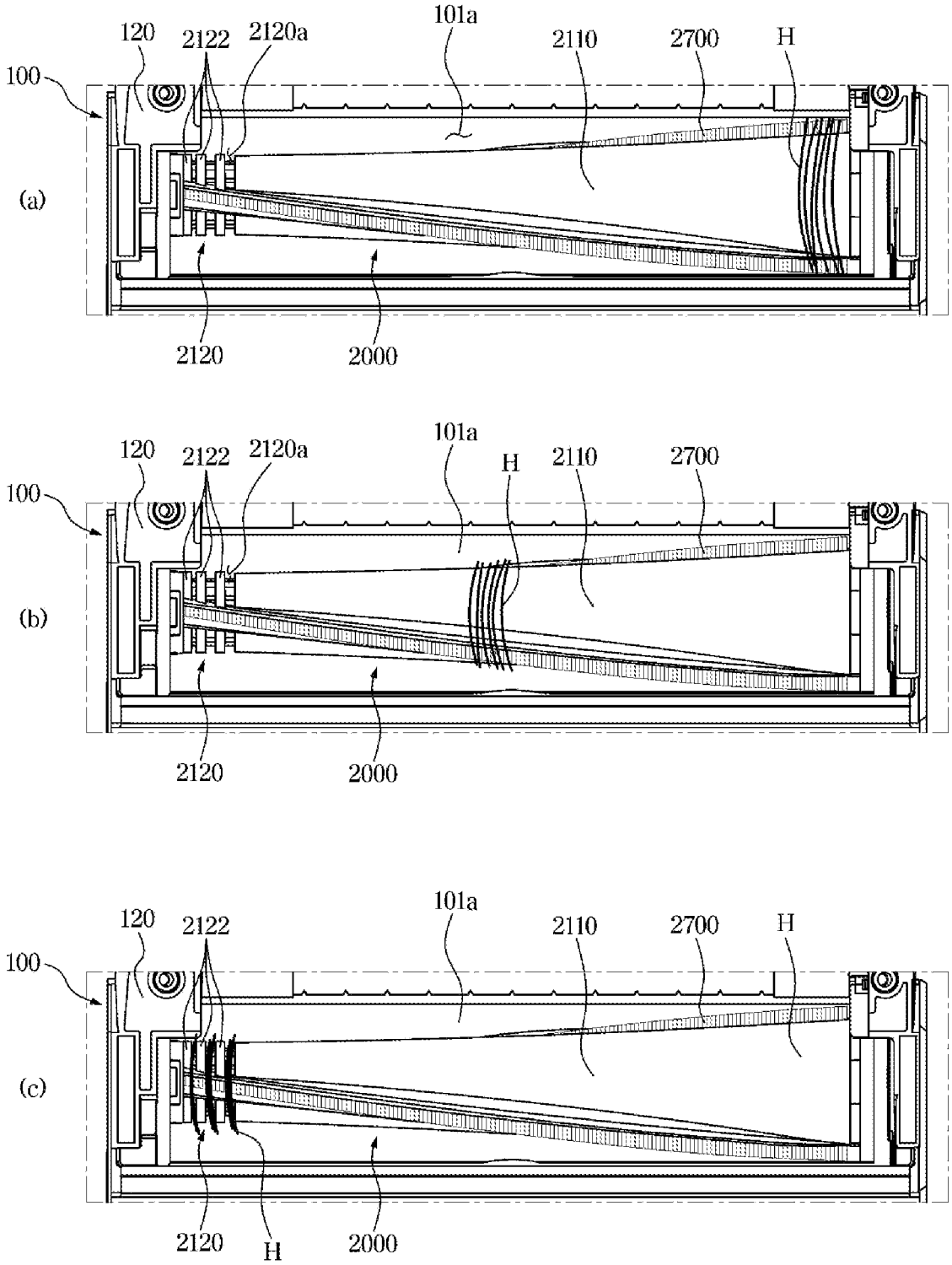
FIG. 19 is a diagram illustrating a sequence in which foreign substances H wound around the drum brush 2000 of FIG. 17 move to the collecting portion 2120 as the drum brush 2000 rotates.
Figure 20:
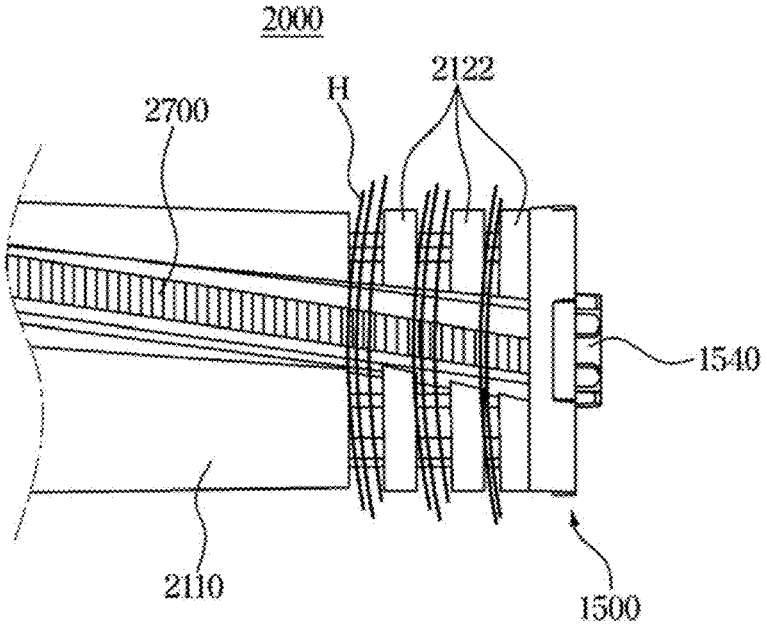
FIG. 20 is an enlarged view of the collecting portion of the drum brush shown in FIG. 17.

FIG. 17 is a diagram illustrating a drum brush 2000 according to an embodiment. FIG. 18 is a bottom view illustrating a suction head 100 on which the drum brush 2000 of FIG. 17 is mounted. FIG. 19 is a diagram illustrating a sequence in which foreign substances H wound around the drum brush 2000 of FIG. 17 are moved to the collecting portion 2120 as the drum brush 2000 rotates. FIG. 20 is an enlarged view of the collecting portion 2120 of the drum brush 2000 shown in FIG. 17.

Referring to FIGS. 17 to 20, a drum brush 2000 may include a collecting portion 2120 positioned on one side of a drum body 2100. The collecting portion 2120 may be positioned on the other side of the drum body 2100. Similarly, the collecting portion 2120 may be provided such that foreign substances are moved thereto.

Since the drum body 2100 has the collecting portion 2120 positioned on one side thereof, the drum body 2100 may have a shape in which the diameter decreases toward the one side. That is, the drum body 2100 may have an approximately truncated cone shape. In this illustration, the collecting portion 2120 is shown as being provided on the side of the driving cap 1500. However, the present invention is not limited thereto, and the collecting portion 2120 may be positioned on the side of the shaft cap 1400.

The collecting portion 2120 may be provided with an opening 2120*a*. Foreign substances H moved to the collecting portion 2120 may be wound around the opening 2120*a*. Similarly, a plurality of protection guides 2122 may be provided in the opening 2120*a*. However, when the lengths of the collecting portion 2120 and the opening 2120*a* are short, the protection guide 2122 may be provided as one or more protection guides rather than in plural.

The drum brush 2000 may include a tapered portion 2110 in which the diameter of the drum body 2100 decreases in a direction toward the collecting portion 2120. The tapered portion 2110 may have a shape in which the diameter gradually decreases along the axis A of the drum body 2100. That is, the tapered portion 2110 may occupy most of the length of the drum body 2100 in the axis A direction.

However, the disclosure is not limited thereto, and the tapered portion 2110 may occupy only a portion of the drum body 2100. In the drum body 2100, a cylindrical portion with a constant diameter may be provided on the side opposite to the collecting portion 2120, and the tapered portion 2110 having a decreasing diameter may be formed from a position at which the cylindrical portion ends.

In addition, although not shown, the collecting portions 2120 may be provided on both sides. Correspondingly, the cutting member 1300 may also be provided as two cutting members 1300 at the positions corresponding to the openings 2120*a* formed in the collecting portions 2120. That is, the drum body 2100 may be formed to have a diameter that is the largest in the axial center and decreases as being directed toward the collecting portions 2120 on both sides of the drum body 2100. In other words, the tapered portions 2110 may be arranged in a direction opposite to that of the tapered portions 1110 show in FIG. 7.

In this case, foreign substances H wound around the drum body 2100 may be moved to both sides of the drum body 2100 and may be cut by the cutting members 1300 exposed to the openings 2120*a* of the collecting portions 2120. Similarly, the cut foreign substances H may be drawn by the suction force of the cleaner 1 and moved to the dust collector 40.

The drum brush 2000 shown in FIGS. 17 to 20 may also include the cutting members 1301, 1302, 1303, and 1304 shown in FIGS. 13 to 16. In addition, the drum brush 2000 may be mounted not only on the cleaner 1 shown in FIG. 1 but also on the robot cleaner 2 shown in FIG. 3.

Hereinafter, description of the same configuration as that of the drum brush 2000 shown in FIGS. 17 to 20 will be omitted, and only other configurations will be described.

Figure 21:
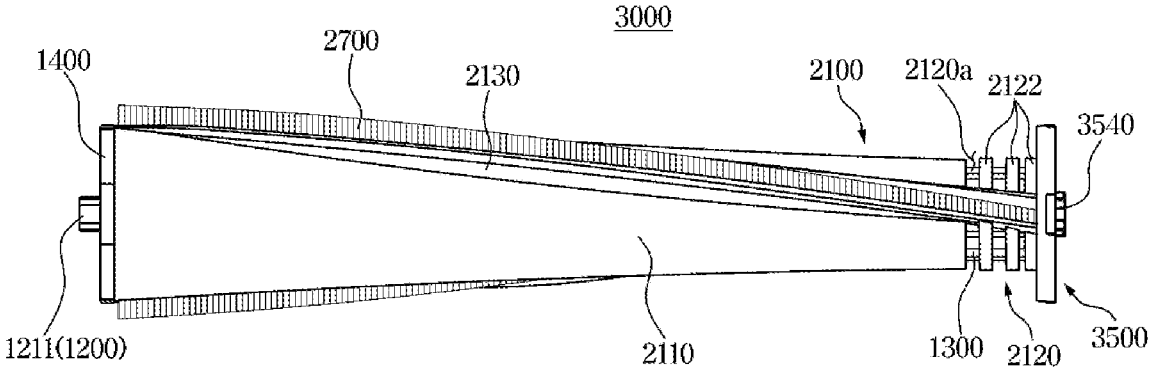
FIG. 21 is a diagram illustrating a drum brush according to an embodiment.

FIG. 21 is a diagram illustrating a drum brush according to an embodiment.

Referring to FIG. 21, a drum brush 3000 may include a driving cap 3500 having a diameter larger than that of the collecting portion 2120. A case in which foreign substances H moved to the collecting portion 2120 pass through the collecting portion 2120 by rotation of the drum body 2100 may exist. In addition, since the collecting portion 2120 may be provided in a shape with a decreasing diameter rather than a constant diameter, or may have various shapes, the foreign substances H may escape from the drum body 2100.

To prevent such a limitation, the driving cap 3500 having a larger diameter than the diameter of the collecting portion 2120 may be disposed to block one side of the collecting portion 2120. Meanwhile, the collecting portion 2120 may be positioned on the side of the driving cap 3500 of the drum body 2100, or may be positioned on the side of the shaft cap 1400. When the collecting portion 2100 is positioned on the side of the shaft cap 1400, the diameter of the shaft cap 1400 may be provided to be larger than the diameter of the collecting portion 1400. As described above, when the collecting portion 2120 is disposed on one side of the drum body 2100, the shaft cap 1400 or the driving cap 3500 may be provided to have a diameter larger than the diameter of the collecting portion 2120.

The drum brush 3000 shown in FIG. 21 may also include the cutting members 1301, 1302, 1303, and 1304 shown in FIGS. 13 to 16. In addition, the drum brush 3000 may be mounted not only on the cleaner 1 shown in FIG. 1 but also on the robot cleaner 2 shown in FIG. 3.

A cleaner according to an embodiment includes: a housing having a suction port 101*a* or 201*a*; a drum brush 1000, 2000, or 3000 disposed inside the housing and configured to guide intake of foreign substances H through the suction port 101*a* or 201*a*; and a driving device 170 connected to the drum brush 1000, 2000, or 3000 and including a motor 171 configured to generate a rotational force. The drum brush 1000, 2000, or 3000 may include a drum body 1100 or 2100 having a hollow, the drum body 1100 or 2100 a collecting portion 1120 or 2120 in which foreign substances are collected, a tapered portion 1110 or 2110 having a diameter that decreases along an axial direction of the drum body 1100 or 2100 for the foreign substances to be moved toward to the collecting portion 1120 or 2120, and an opening 1120*a* or 2120*a* formed in the collecting portion 1120 or 2120. The drum brush 1000, 2000, or 3000 may include a core shaft 1200 disposed in the hollow of the drum body 1100 or 2100. The drum brush 1000, 2000, or 3000 may include a cutting member 1300, 1301, 1302, 1303, or 1304 provided in the core shaft 1200 while being exposed through the opening 1120*a* or 2120*a* to cut the foreign substances H. According to an aspect of the disclosure, the cleaner may be easy to maintain. According to an aspect of the disclosure, the cleaner may easily cut foreign substances entangled in the drum. According to an aspect of the disclosure, the cleaner may automatically cut foreign substances according to rotation of the drum brush. According to an aspect of the disclosure, foreign substances entangled in the drum brush may be drawn into the dust collector.

The core shaft may be fixed to the housing to be prevented from rotating. According to the disclosure, only by rotation of the drum body, foreign substances may be more effectively cut.

The driving device may be coupled to one side of the drum brush, and the core shaft may be fixed to the housing on the other side of the drum brush. According to the disclosure, efficient arrangement may be implemented to allow rotation of the drum body at the same time as fixing of the core shaft.

The drum body may further include a plurality of protection guides arranged to cover at least a portion of the opening. According to the disclosure, injury caused by the cutting member may be prevented.

The plurality of protection guides may be formed along a circumferential direction of the drum body such that the foreign substances wound according to rotation of the drum brush may be introduced through between the plurality of protection guides. According to the present disclosure, injury may be prevented while securing a space which foreign substances may enter.

The collecting portion may be positioned at a center of the drum body along the axial direction of the drum body.

According to the present disclosure, since the collecting portion may be positioned close to a communication hole, cut foreign substances may be most efficiently drawn.

The tapered portion may include a first tapered portion 1110 positioned on one side of the collecting portion and a second tapered portion 2110 positioned on an other side of the collecting portion.

The collecting portion of the drum body may have a section with a constant diameter along the axial direction of the drum body. According to the present disclosure, the capacity of the collecting portion for accommodating foreign substances may be secured.

The collecting portion may be positioned at one end of the drum body. According to the present disclosure, the drum brush may be miniaturized and used for a small vacuum cleaner. According to the present disclosure, foreign substances that have not yet been cut may be easily removed.

The drum brush may further include a bearing 1610 or 1620 configured to support the core shaft such that the drum body rotates relative to the core shaft. According to the present disclosure, the rotational force generated by the driving device may be transmitted only to the drum body without being transmitted to the core shaft. According to the present disclosure, foreign substances entangled in the drum body may be efficiently cut because the drum body rotates relative to the core shaft and the cutting member.

The cutting member may be disposed to penetrate the core shaft. According to the present disclosure, since the space occupied by the cutting member is minimized, spatial efficiency may be ensured The cutting member may include a body portion coupled to the core shaft and a cutting portion protruding from the body portion.

The core shaft may include a recessed portion configured to restrict rotation of the cutting member, and the cutting member may further include a protruding portion corresponding to the recessed portion. According to the present disclosure, even with various external forces acting on the cutting member, the cutting member may be kept fixed to the core shaft without rotating. According to the present disclosure, the performance of cutting foreign substances may be improved.

The core shaft may further include a locking plate 1230 configured to restrict the cutting member from moving along a longitudinal direction of the core shaft. According to the present disclosure, structural safety may be secured by restricting the longitudinal movement of the cutting member.

The collecting portion of the drum body may include a rubber material. According to the present disclosure, foreign substances may be more strongly wound around the collecting portion and more strongly rubbed against the cutting member.

A cleaner according to an embodiment includes: a housing 102 or 201 having a suction port 101*a* or 201*a*; and a drum brush 1000, 2000, or 3000 configured to guide intake of foreign substances H through the suction port. The drum brush may include a drum body configured to be rotatable, the drum body including: a collecting portion 1120 or 2120 in which foreign substances are collected; an opening 1120*a* or 2120*a* formed in the collecting portion 1120 or 2120; and a tapered portion 1110 or 2110 having a diameter that decreases in a direction toward the collecting portion. The drum brush may include a core shaft 1200 disposed in the drum body and fixed to the housing. The drum brush may include a cutting member 1300, 1301, 1302, 1303, or 1304 coupled to the core shaft and configured to cut the foreign substances collected in the opening. According to an aspect of the disclosure, the cleaner may be easy to maintain. According to an aspect of the disclosure, the cleaner may easily cut foreign substances entangled in the drum. According to an aspect of the disclosure, the cleaner may automatically cut foreign substances according to rotation of the drum brush. According to an aspect of the disclosure, foreign substances entangled in the drum brush may be drawn into the dust collector.

The drum body may further include a plurality of protection guides 1122 or 2122 arranged to cover at least a portion of the opening. According to the disclosure, injury caused by the cutting member may be prevented.

The cleaner may further include a driving device 170 disposed in the housing. The driving device may be connected to the drum brush and rotate the drum body relative to the core shaft. According to the present disclosure, the rotational force generated by the driving device may be transmitted only to the drum body without being transmitted to the core shaft. According to the present disclosure, foreign substances entangled in the drum body may be efficiently cut because the drum body rotates relative to the core shaft and the cutting member.

A cleaner according to an embodiment includes: a housing 102 or 201 having a suction port 101*a* or 201*a*; a drum brush 1000, 2000, or 3000 disposed inside the housing and configured to guide intake of foreign substances H through the suction port; and a driving device 170 connected to the drum brush and configured to generate a rotational force. The drum brush may include a drum body having a hollow and provided at an axial direction center region with a collecting portion, the drum body including: a first tapered portion 1110 and a second tapered portion 2110 positioned on opposite sides of the collecting portion and having a diameter that decreases in a direction toward the collecting portion; and an opening formed in the colleting portion. The drum brush may include a core shaft disposed in the hollow of the drum body and fixed to the housing. The drum brush may include a cutting member provided in the core shaft while being exposed through the opening to cut foreign substances H collected in the collecting portion. According to an aspect of the disclosure, the cleaner may be easy to maintain. According to an aspect of the disclosure, the cleaner may easily cut foreign substances entangled in the drum. According to an aspect of the disclosure, the cleaner may automatically cut foreign substances according to rotation of the drum brush. According to an aspect of the disclosure, foreign substances entangled in the drum brush may be drawn into the dust collector.

The drum body may further include a plurality of protection guides 1122 that may be formed on the opening along a circumferential direction of the drum body. According to the disclosure, injury caused by the cutting member may be prevented.

According to an aspect of the disclosure, the cleaner may be easy to maintain. According to an aspect of the disclosure, the cleaner may easily cut foreign substances entangled in the drum.

According to an aspect of the disclosure, the cleaner may automatically cut foreign substances according to rotation of the drum brush.

According to an aspect of the disclosure, foreign substances entangled in the drum brush may be drawn into the dust collector.

The effects of the present disclosure are not limited to those described above, and other effects that are not described above will be clearly understood by those skilled in the art from the above detailed description.

While the disclosure has been shown and described with reference to various embodiments thereof, it will be understood by those skilled in the art that various changes in form and details may be made therein without departing from the spirit and scope of the disclosure as defined by the appended claims and their equivalents.

The invention claimed is:

1. A cleaner comprising:

a housing having a suction port configured to take in foreign substances;

a motor configured to generate a rotational force; and a drum brush inside the housing and configured to rotate by the rotational force, the drum brush including:

a drum body having:

a collecting portion having an opening, a tapered portion having a diameter that decreases along an axial direction of the drum body toward the collecting portion so that, when the drum brush rotates, the taken in foreign substances move toward the collecting portion and then through the opening, and a hollow, a core shaft in the hollow, and a cutting member in the hollow and on the core shaft at a position corresponding to the opening so that the foreign substances moved through the opening are cut by the cutting member.

2. The cleaner of claim 1, wherein the core shaft is fixed to the housing so that the core shaft is prevented from rotating when the drum brush rotates.

3. The cleaner of claim 2, wherein the motor is coupled to a first side of the drum brush, and the core shaft is fixed to the housing on a second side of the drum brush opposite the first side.

4. The cleaner of claim 1, wherein the drum body further includes a plurality of protection guides covering at least a portion of the opening.

5. The cleaner of claim 4, wherein the plurality of protection guides are formed along a circumferential direction of the drum body so that the taken in foreign substances are wound around the drum brush and move through the opening between the plurality of protection guides when the drum brush rotates.

6. The cleaner of claim 1, wherein the collecting portion is positioned at a center of the drum body along the axial direction of the drum body.

7. The cleaner of claim 6, wherein the tapered portion includes a first tapered portion positioned on a first side of the collecting portion, and a second tapered portion positioned on a second side of the collecting portion.

8. The cleaner of claim 1, wherein the collecting portion includes a section extending along the axial direction of the drum body having a constant diameter.

9. The cleaner of claim 1, wherein the collecting portion is at one end of the drum body.

10. The cleaner of claim 1, wherein the drum brush further includes a bearing configured to support the core shaft so that the drum body rotates relative to the core shaft when the drum brush rotates.

11. The cleaner of claim 1, wherein the cutting member passes through a center of the core shaft.

12. The cleaner of claim 1, wherein the cutting member includes a body portion coupled to the core shaft and a cutting portion protruding from the body portion.

13. The cleaner of claim 1, wherein the core shaft is fixed to the housing and includes a recessed portion, and the cutting member includes a protruding portion corresponding to, and extending into, the recessed portion so that the cutting member is restricted from rotating when the drum brush rotates.

14. The cleaner of claim 13, wherein the core shaft further includes a locking plate configured to restrict movement of the cutting member along a longitudinal direction of the core shaft.

15. The cleaner of claim 1, wherein the collecting portion includes a rubber material.

* * * * *